US006905111B2

(12) United States Patent
Nagasaka et al.

(10) Patent No.: US 6,905,111 B2
(45) Date of Patent: Jun. 14, 2005

(54) APPARATUS AND METHOD FOR PRODUCING AQUEOUS CARBONIC ACID SOLUTION

(75) Inventors: Yoshinori Nagasaka, Tokyo (JP); Hiroki Sakakibara, Tokyo (JP); Yuichi Morioka, Nagai (JP); Katsuya Sanai, Tokyo (JP); Michio Kanno, Tokyo (JP); Satoshi Takeda, Nagoya (JP)

(73) Assignees: Mitsubishi Rayon Engineering Co., Ltd., Tokyo (JP); Mitsubishi Rayon Co., Ltd., Tokyo (JP)

( * ) Notice: Subject to any disclaimer, the term of this patent is extended or adjusted under 35 U.S.C. 154(b) by 3 days.

(21) Appl. No.: 10/258,031

(22) PCT Filed: Apr. 18, 2001

(86) PCT No.: PCT/JP01/03309

§ 371 (c)(1),
(2), (4) Date: Oct. 18, 2002

(87) PCT Pub. No.: WO01/78883

PCT Pub. Date: Oct. 25, 2001

(65) Prior Publication Data

US 2003/0122268 A1 Jul. 3, 2003

(30) Foreign Application Priority Data

| | | |
|---|---|---|
| Apr. 18, 2000 | (JP) | 2000-116501 |
| Apr. 18, 2000 | (JP) | 2000-116502 |
| Apr. 18, 2000 | (JP) | 2000-116503 |
| Aug. 10, 2000 | (JP) | 2000-242601 |
| Aug. 21, 2000 | (JP) | 2000-249738 |
| Aug. 30, 2000 | (JP) | 2000-260701 |

(51) Int. Cl.[7] ..... B01F 3/04

(52) U.S. Cl. ..... 261/36.1; 261/64.3; 261/102; 261/122.1; 261/DIG. 7

(58) Field of Search ..... 261/36.1, 37, 38, 261/64.3, 72.1, 74, 77, 94, 95, 96, 100, 101, 102, 104, 121.1, 122.1, DIG. 7

(56) References Cited

U.S. PATENT DOCUMENTS

| | | | | |
|---|---|---|---|---|
| 3,643,688 A | * | 2/1972 | Meinert | 137/556 |
| 5,505,841 A | * | 4/1996 | Pirbazari et al. | 210/90 |
| 6,164,632 A | * | 12/2000 | Uchida et al. | 261/102 |

FOREIGN PATENT DOCUMENTS

| | | |
|---|---|---|
| JP | 49-23280 | 6/1974 |
| JP | 61-164630 | 7/1986 |
| JP | 02-279158 | 11/1990 |
| JP | 05-115521 | 5/1993 |
| JP | 06-198152 | 7/1994 |
| JP | 07-096156 | 4/1995 |
| JP | 08-215270 | 8/1996 |
| JP | 08-215271 | 8/1996 |
| WO | WO 98/34579 | 8/1998 |

* cited by examiner

*Primary Examiner*—Scott Bushey
(74) *Attorney, Agent, or Firm*—Kendrew H. Colton; Fitch, Even, Tabin & Flannery

(57) ABSTRACT

A carbonic water production apparatus equipped with a carbonic acid gas dissolving apparatus 3 and a circulation pump 1 wherein water in a bath 11 is circulated by the circulation pump 1, and a carbonic acid gas is fed into the carbonic acid gas dissolving apparatus 3 to dissolve the carbonic acid gas in the water, and wherein the circulation pump 1 is a positive-displacement metering pump having a self-priming ability; a carbonic water production method using this apparatus; a carbonic water production method comprising an early step for producing a carbonic water and a concentration maintaining step for the carbonic water; a carbonic water production apparatus equipped with a control for controlling the feeding pressure of carbonic water gas so that give an intended concentration of carbonic acid gas; a carbonic water production apparatus which automatically discharges out a drain; and a carbonic water production apparatus combined with a portable foot bath.

12 Claims, 10 Drawing Sheets

APPARATUS AND METHOD FOR PRODUCING AQUEOUS CARBONIC ACID SOLUTION

CROSS-REFERENCED APPLICATIONS

This application is the 371 National phase of International Application PCT/JP01/03309, filed Apr. 18, 2001, which designated the U.S. and that International Application was not published under PCT Article 21(2) in English.

TECHNICAL FIELD

The present invention relates to an apparatus and a method for producing carbonic acid water which is useful, for example, in hydrotherapy for the purpose of improving physiological functions.

BACKGROUND ART

Carbonic water is assumed to be effective for treatment of regressive diseases and peripheral circulatory disorders. For example, there is a method in which carbonic acid gas is fed in the form of bubbles into a bath (bubbling method), as a method of artificially producing carbonic water. However, the dissolving ratio is low, and the dissolution time is long in this method. Another method is a chemical method in which a carbonate salt is reacted with an acid (chemical method). However, it is necessary to add the chemical materials in large amounts, and it is impossible to keep a clearness in this method. Additionally, there is a method in which hot water and carbonic acid gas are sealed in a tank for a period of time while it is pressurized (pressure method). However, the size of the apparatus is increased impractically in this method.

Currently, commercially marketed apparatuses of producing carbonic water are used for producing carbonic water having a low concentration of carbonic acid gas which is about 100 to 140 mg/L. The apparatuses have no means of controlling the concentration of carbonic acid gas.

On the other hand, Japanese Patent Application Laid Open (JP-A) No. 2-279158 discloses a method in which a carbonic acid gas is fed through a hollow fiber semi-permeable membrane and absorbed by hot water. Further, JP-A No. 8-215270 discloses a method in which a pH sensor is put in a bath, and controls the feeding rate of carbonic acid gas into a carbonic acid gas dissolving apparatus for maintaining the concentration of the carbonic acid gas at a constant level in the water in the bath. Furthermore, International Publication No. 98/34579 pamphlet discloses a method in which concentration data for carbonic acid gas from the carbonic water produced is calculated from the pH value of carbonic water and the alkalinity of raw water. The feeding rate of carbonic acid gas is controlled so that the concentration of carbonic acid gas in carbonic water can reach its intended value. These are methods in which carbonic water is produced by passing once raw water through the carbonic acid gas dissolving apparatus that is equipped with a hollow membrane. The apparatus is called a one-pass type apparatus.

In the one-pass type apparatus, it is necessary to increase the membrane area of the hollow fiber membrane or to increase the pressure of carbonic acid gas in order to produce carbonic water having a high concentration which is excellent for physiological effects (e.g., blood flow increase). However, if the membrane area is increased, the size of the apparatus increases, and therefore it causes the cost to increase. Accordingly, if the pressure of gas is increased, the dissolving ratio becomes low. Furthermore, in the one-pass type apparatus, it is indispensable to have a pipe and a hose connection between the apparatus and hot water, such as tap water. As a result the connection must be re-set in every case that allows the apparatus to be moved for use anyplace.

On the other hand, carbonic water having a high concentration can be produced efficiently and at low cost by a so-called circulation type apparatus wherein hot water in a bath is circulated by a circulation pump through a carbonic acid gas dissolving apparatus. Additionally, the setting of the circulation type apparatus is very simple because it needs no additional connections, as is required in the one path type apparatus, but rather it is completed by filling a bath with hot water and putting a carbonic water circulation hose from the apparatus into the bath. Examples of such circulation type carbonic water apparatuses include those disclosed by JP-A Nos. 8-215270 and 8-215271.

Under a condition in which carbonic water having a desired concentration of carbonic acid gas is filled in a bath, the carbonic acid gas in the carbonic water is evaporated, which results in gradually decreasing the concentration of carbonic acid gas. This tendency depends on the size of the bath. Particularly, when a large bath is filled with carbonic water for a large number of people, its evaporation rate is high, and the concentration of carbonic acid gas is quickly decreased. In a large bath for a large number of people, the hot water is often circulated through a filtration apparatus for cleaning the hot water even while the bath is being used. However, the carbonic acid gas evaporates in large amounts at the filtration apparatus if the carbonic water is contained in a circulation type bath in which the water is circulated through the filtration apparatus.

The method in which the feeding amount of carbonic acid gas is controlled based on the pH value, has a relatively large calculating error in determining the concentration of carbonic acid gas in the resulting carbonic water. Therefore, it is necessary to add an automatic correction factor to the pH sensor for suppressing the calculating error thereof within ±0.05. This requires complicated control techniques, increases the size of the apparatus and increases the cost. Additionally, the alkalinity of raw water (e.g., tap water) should be measured to control precisely the concentration of carbonic acid gas.

Examples of carbonic acid gas production apparatuses include so-called one-pass type apparatuses as disclosed in JP-A No. 2-279158, International Publication No. 98/34579 pamphlet in which carbonic water is produced by passing raw water once through a carbonic acid gas dissolving apparatus equipped with a hollow fiber membrane, and so-called circulation type apparatuses as disclosed in JP-A Nos. 8-215270 and 8-215271 in which hot water from a bath is circulated through a carbonic acid gas dissolving apparatus by a circulation pump. In any type apparatus, excess water collects at the outer parts of the hollow fiber membrane. The excess water permeates through the membrane from the hollow part of the hollow fiber membrane, or it is generated by the condensation of vapor which permeates through the membrane from the hollow part. When the excess water comes into contact with the surface of the membrane, the surface becomes clogged, and the gas permeation cannot be effectively performed. In conventional apparatuses, an operator appropriately opens a drain valve to discharge the excess water collected at the outside parts of the hollow fiber membrane.

It is conventionally known that a foot bath of carbonic water may improve the physiological functions of the foot.

In a conventional foot bath, it is necessary that the foot bath is filled with carbonic water that was previously produced, or that the carbonic water was produced from hot water filled in the bath by using another apparatus. These operations are complicated to use. A portable type foot bath has merit in that the foot bath treatment can be conducted easily in any place, but the merit is restricted by the operations available for producing the carbonic water.

DISCLOSURE OF INVENTION

A first object of the present invention is to realize a more practical circulation type carbonic water production apparatus, and to provide an apparatus and a method that can produce carbonic water having a desired concentration of carbonic acid gas (particularly, a high concentration such that physiological effects are obtained) and through a simple operation at low cost.

A second object of the present invention is to provide a method of producing carbonic water which solves the problem of evaporation of the carbonic acid gas, and can produce and maintain a certain concentration of carbonic acid gas for a long period of time through a simple operation at low cost.

A third object of the present invention is to provide an apparatus and a method that can produce carbonic water always having a certain concentration of carbonic acid gas (particularly, a high concentration such that physiological effects are obtained) through a simple operation at low cost, and irrespective of the flow rate of raw water.

A fourth object of the present invention is to realize a more practical carbonic water production apparatus, and to provide an apparatus and a method that can produce carbonic water through a simple operation.

A fifth object of the present invention is to provide a carbonic water production apparatus that can be used by a simple operation, while retaining the advantages of portable foot baths.

The first present invention relates to a carbonic water production apparatus which is equipped with a carbonic acid gas dissolving apparatus and a circulation pump wherein water in a water tank is circulated through the carbonic acid gas dissolving apparatus by the circulation pump, and carbonic acid gas is fed into the carbonic acid gas dissolving apparatus to dissolve the carbonic acid gas into the water, and which is characterized by a circulation pump that is a positive-displacement metering pump with a self-priming ability; and, a carbonic water production method which comprises circulating water in a water tank through a carbonic acid gas dissolving apparatus by a circulation pump, and feeding carbonic acid gas into the carbonic acid gas dissolving apparatus to dissolve the carbonic acid gas into the water, and which is characterized by a positive-displacement metering pump with a self-priming ability used as the circulation pump.

On the other hand, according to the first present invention, carbonic water can be successfully circulated even if the carbonic water has a high concentration because a positive-displacement metering pump with a self-priming ability is used. It results in a water tank that can be filled with carbonic water having a high concentration.

Regarding conventional circulation type carbonic water apparatuses, JP-A No. 8-215270 discloses no information about which kind of circulation pump is suitable for the production of carbonic water. JP-A No. 8-215270 discloses an underwater pump used as the circulation pump. However, bubbling of the circulated carbonic water is caused significantly by swirling pumps, such as the underwater pump, when the carbonic water has a high concentration, and it is this bubbling that may reduce the pump discharge amount and pump head. In the worst case, blades of the pump often idle so that it becomes impossible to circulate the carbonic water.

The second present invention relates to a carbonic water production method which comprises circulating water in a water tank through a carbonic acid gas dissolving apparatus by a circulation pump, and feeding carbonic acid gas into the carbonic acid gas dissolving apparatus to dissolve the carbonic acid gas into the water, and which is characterized by comprising an initial step of applying a necessary pressure to the carbonic acid gas in order to produce carbonic water having a desired concentration of carbonic acid gas in the initial circulation of the water for producing the carbonic water, and a concentration maintaining step of applying a necessary pressure to the carbonic acid gas and circulating the carbonic water in order to maintain the desired concentration of carbonic acid gas in the carbonic water produced at this initial step.

The second present invention is a method in which carbonic water having a high concentration is efficiently produced at an initial step, and furthermore, the concentration of carbonic acid gas is maintained by also applying the carbonic acid gas process to water which is circulated for cleaning while in use, particularly while in use by a large number of people in a large bath. This method can produce and maintain a certain concentration of carbonic acid gas for a long period of time through a simple operation at low cost.

The third present invention relates to a carbonic water production apparatus which feeds carbonic acid gas into a carbonic acid gas dissolving apparatus thereof while feeding raw water therein to dissolve the carbonic acid gas in the raw water, and which is characterized by previously recorded correlation data of the flow rate of raw water with the feed pressure of carbonic acid gas and the concentration of carbonic acid gas in which results the carbonic water, and is equipped with a means for detecting the flow rate of raw water and controlling the feed pressure of carbonic acid gas according to the correlation data so that the resulting carbonic water has the intended concentration of carbonic acid gas at the time of producing the carbonic water; and a carbonic water production method which comprises feeding carbonic acid gas into a carbonic acid gas dissolving apparatus while feeding raw water to dissolve the carbonic acid gas into the raw water, and which is characterized by comprising a step of previously recorded correlation data of the flow rate of raw water with the feed pressure of carbonic acid gas and the concentration of carbonic acid gas which results in the carbonic water, and a step of detecting the flow rate of raw water and controlling the feed pressure of carbonic acid gas according to the correlation data so that the resulting carbonic water has the intended concentration of carbonic acid gas at the time of producing the carbonic water.

According to the third present invention, carbonic water always having a certain high concentration can be produced by a simple operation at low cost without controlling the flow rate of raw water, as compared with a conventional method in which the feed amount of carbonic acid gas is controlled based on the measured value of the pH.

The fourth present invention relates to a carbonic water production apparatus which is equipped with a membrane type carbonic acid gas dissolving apparatus, and which is characterized by being equipped with an automatic water extraction means for automatically discharging out the excess water accumulated in the membrane type carbonic acid gas dissolving apparatus; and a carbonic water production method which applies a membrane type carbonic acid gas dissolving apparatus, and which is characterized by comprising a step of automatically discharging out the excess water accumulated in the membrane type carbonic acid gas dissolving apparatus.

According to the fourth present invention, an effective membrane area can always be ensured and a high concentration of carbonic acid gas in carbonic water can be successfully produced by the simple operation described without manual water extraction by hand-operation.

In the fifth present invention, the term "portable" means that the foot bath is not fixed at a certain place, and if necessary, can be carried and moved. The carrying method is not particularly restricted. According to the fifth present invention, a bath can be provided, which can be used by a simple operation, while retaining the advantages of portable foot baths.

BEST MODE FOR CARRYING OUT THE INVENTION

Figure 1:
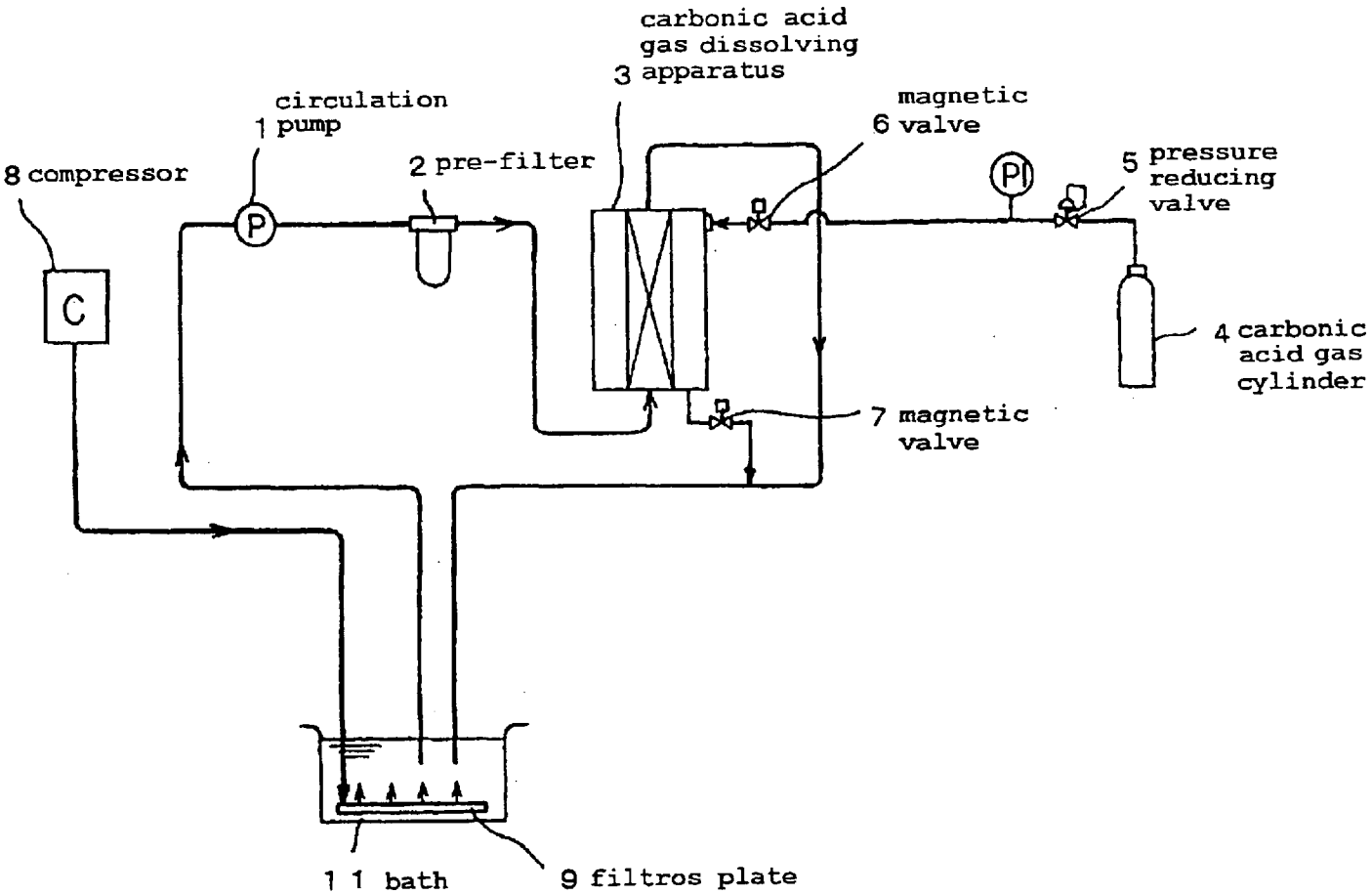
FIG. 1 is a flow sheet showing one example of a circulation type carbonic water production apparatus according to the first present invention.

FIG. 1 is a flow sheet showing one example of a circulation type carbonic water production apparatus according to the first present invention. In this example, hot water in the bath (water tank) (11) is circulated. The temperature of the water in the bath (11) is not particularly restricted. Here, temperatures around body temperature or lower are preferable in order to manifest physiological effects of carbonic water and not to apply surplus load on the body and the diseased part. Specifically, temperatures from 32 to 42° C. are preferable.

In the example shown in FIG. 1, hot water in the bath (11) is sucked up by a circulation pump (1), and introduced into the carbonic acid gas dissolving apparatus (3) via the pre-filter (2) for trapping debris from the hot water, and returned again to the bath (11). The carbonic acid gas is fed from the carbonic acid gas cylinder (4), via the pressure-reducing valve (5) and the magnetic valve (6), which is a cut off valve for the carbonic acid gas, into the carbonic acid gas dissolving apparatus (3).

Water to be circulated is not particularly restricted. When water containing no carbonic acid gas at all before circulation is circulated, carbonic water will be produced having gradually increasing concentrations of carbonic acid gas during circulation. Furthermore, higher concentrations of carbonic acid gas can also recovered by circulating carbonic water having low concentrations of carbonic acid gas.

In this example, water in the bath (11) is circulated. Applying such an apparatus of the present invention to a bath is a very useful example. However, the first present invention is not limited to this. The first present invention can also be applied to a water tank, such as a water storage tank or a feed water tank, which is filled with carbonic water having a desired concentration.

The carbonic acid gas dissolving apparatus (3) is a membrane type carbonic acid gas dissolving apparatus made up of a membrane module having a hollow fiber membrane installed. In this example, carbonic acid gas fed into the carbonic acid gas dissolving apparatus (3) is introduced onto the outer surface of the hollow fiber membrane. Hot water is fed in the carbonic acid gas dissolving apparatus (5) and flows into the hollow part of the hollow fiber membrane. Subsequently, carbonic acid gas on the outer surface of the hollow fiber membrane comes into contact with the hot water flowing into the hollow part of the hollow fiber membrane via a membrane surface, carbonic acid gas is dissolved in the hot water to produce carbonic water, and this carbonic water is then fed into the bath (11). By thus circulating hot water in the bath (11) by using the circulation pump (1) for an optional time, carbonic water having high concentrations of carbonic acid gas will be produced in the bath (11). When contact and dissolution of carbonic acid gas is conducted via a membrane surface of a membrane module as in this example, the gas-liquid contact area can be increased, and carbonic acid gas can be dissolved with higher efficiency. A membrane module may consist of, for example, a hollow fiber membrane module, a plate membrane module, and a spiral type module. In particular, a hollow fiber membrane module can dissolve carbonic acid gas with a higher efficiency.

Hot water in the bath (11) increases in concentration of carbonic acid gas with elapsed circulation time. When correlation data between the circulation time and the concentration of carbonic acid gas are previously measured, the circulation time needed can be determined from the correlation data if the intended concentration of carbonic acid gas and feed pressure of carbonic acid gas are known. However, the correlation data cannot be utilized if the amount of water circulated is not always constant, therefore, it is necessary to use a metering pump as the circulation pump (1). However, according to knowledge of the present inventors, even in the case of metering pumps, volute pumps, and the like, the correlation data cannot be used since the pump flow rate can vary with a change in head which may occur with clogging of a pre-filter. Additionally, when carbonic water reaches a high concentration, the pump may stop because of bubbling.

Therefore, according to the first present invention, stable circulation and a constant amount of water circulated can be realized by using a positive-displacement metering pump with a self-priming ability such as the circulation pump (1). This positive-displacement metering pump has a self-priming ability which can be activated in the initial operation without priming. Additionally, even though carbonic water tends to generate bubbles when its concentration increases, this positive-displacement metering pump can convey the water constantly even under bubble rich conditions.

The positive-displacement metering pump is very effective particularly when correlation data is obtained for the circulation flow rate of the positive-displacement metering pump, the gas feeding pressure at water amount in water tank, the concentration of carbonic acid gas in carbonic water in the water tank, and the circulation time. Therefore in producing carbonic water, the circulation time can be controlled based on the above-mentioned correlation data to give a concentration of carbonic acid gas in the range of 600 mg/L to 1400 mg/L in carbonic water in the water tank.

Positive-displacement metering pumps with a self-priming ability may consist of, for example, a diaphragm pump, a screw pump, a tube pump and a piston pump. Among commercially available products, a diaphragm pump is optimal from the standpoints of price, ability, size and the like. Examples of diaphragm pumps that can be used, are a 3-head diaphragm pump manufactured by SHURflo (US), a 5-head diaphragm pump manufactured by Aquatec Water System (US), a 4-head diaphragm pump manufactured by FLOJET (US), and the like. These commercially available products are usually marketed as booster pumps in a beverage filtration apparatus. Namely, these commercially available products have no relation to a carbonic water production apparatus.

The pressure of carbonic acid gas fed to the carbonic acid gas dissolving apparatus (3) is set by the pressure-reducing valve (5). When this pressure is lower, generation of non-dissolved gas at the carbonic acid gas dissolving apparatus (3) is suppressed, and the dissolution efficiency is higher. The permeation amount of carbonic acid gas through a hollow fiber membrane of the carbonic acid gas dissolving apparatus (3) is in proportion to the feed pressure of carbonic acid gas, such that when the pressure is higher, the permeation amount is higher. Using this information and taking into consideration that when the carbonic acid gas pressure is lower, the production time is longer, the pressure used should be appropriately from about 0.01 to 0.3 MPa. The absorption amount of carbonic acid gas into the circulating hot water depends also on the concentration of carbonic acid gas and the amount of hot water citculated. When carbonic acid gas over the absorption amount is fed, a non-dissolved gas is formed.

Figure 2:
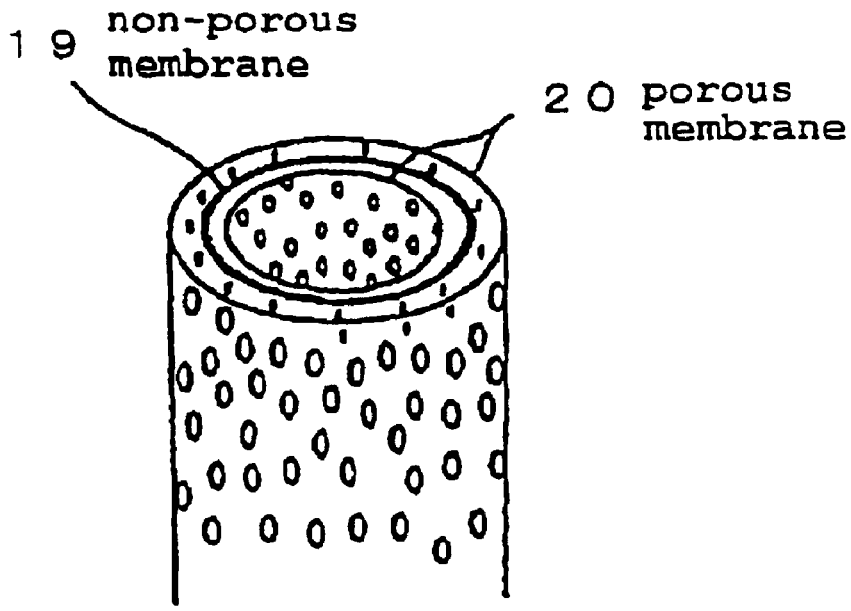
FIG. 2 is a schematic view showing one example of a three-layer complex hollow fiber membrane.

Any material may be used in the carbonic acid gas dissolving apparatus (5) as a hollow fiber membrane, providing it has excellent gas permeability, such as a porous membrane or a non-porous membrane with gas permeability (hereinafter, abbreviated as "non-porous membrane"). Of the porous hollow fiber membranes, those having an opening pore diameter on its surface of 0.01 to 10 $\mu$m are preferable. A hollow fiber membrane containing a non-porous membrane can also be used. The most preferable hollow fiber membrane is a complex hollow fiber membrane with a three-layer structure comprising a non-porous layer in the form of a thin membrane, both sides of which are sandwiched between porous layers. An example of a three layer complex hollow fiber membrane is (MHF, trade name) manufactured by Mitsubishi Rayon Co. Ltd. FIG. 2 is a schematic view showing one such example of a complex hollow fiber membrane. In the example shown in FIG. 2, a non-porous layer (19) is shown as a very thin membrane that is excellent in gas permeability, and porous layers (20) are shown on either side of it, which protect the non-porous layer (19) so that it is not damaged.

Here, the non-porous layer (membrane) is a membrane through which a gas permeates by a mechanism of dissolution and diffusion into a membrane substrate, and any membrane can be used providing it contains substantially no pores through which a gas can permeate in the form of a gas like the Knudsen flow of molecules. When this non-porous membrane is used, a gas can be supplied and dissolved without discharging carbonic acid gas in the form of bubbles into the hot water, therefore, efficient dissolution is possible, additionally, the gas can be dissolved simply under excellent control at any concentration. Furthermore, there is no counterflow which occurs in the case of a porous membrane, namely, hot water does not counterflow to the gas feeding side through the fine pores.

The thickness of a hollow fiber membrane is preferably 10 to 150 $\mu$m. When the membrane thickness is 10 $\mu$m or more, sufficient membrane strength tends to be shown. When the thickness is 150 $\mu$m or less, sufficient carbonic acid gas permeation speed and dissolving efficiency are liable to be shown. In the case of a three-layer complex hollow fiber membrane, the thickness of a non-porous membrane is preferably 0.3 to 2 $\mu$m. When the membrane thickness is 0.3 $\mu$m or more, the membrane does not easily deteriorate, and therefore leakage due to membrane deterioration does not readily occur. When the thickness is 2 $\mu$m or less, sufficient carbonic acid gas permeation speed and dissolving efficiency are liable to be shown.

When the volume of water passed per hollow fiber membrane module is 0.2 to 30 L/min and the gas pressure is 0.01 MPa to 0.3 MPa, it is preferable that the membrane area is about 0.1 $m^2$ to 15 $m^2$.

Examples of the membrane materials for a hollow fiber membrane include silicone-based, polyolefin-based, polyester-based, polyamide-based, polysulfone-based, cellulose-based and polyurethane-based materials and the like. As the material for a non-porous membrane of a three-layer complex hollow fiber membrane, polyurethane, polyethylene, polypropylene, poly4-methylpentene-1, polydimethylsiloxane, polyethylcellulose and polyphenylene oxide are preferable. Among them, polyurethane manifests excellent membrane forming property and provides little eluted substance, and therefore, it is particularly preferable.

The internal diameter of a hollow fiber membrane is preferably 50 to 1000 $\mu$m. When the internal diameter is 50 $\mu$m or more, the flow route resistance of fluid flowing in a hollow fiber membrane decreases appropriately, and feeding of fluid becomes easy. When 1000 $\mu$m or less, the size of a dissolving apparatus can be decreased, providing a merit in compactness of the apparatus.

When a hollow fiber membrane is used in a carbonic acid gas dissolving apparatus, there is a method in which carbonic acid gas is fed to the hollow side of a hollow fiber membrane and hot water is fed to the outer surface side to dissolve the carbonic acid gas, and another method in which carbonic acid gas is fed to the outer surface side of a hollow fiber membrane and hot water is fed to the hollow side to dissolve the carbonic acid gas. Among them, the latter method is particularly preferable since carbonic acid gas can be dissolved at a high concentration in hot water irrespective of the form of a membrane module.

Besides the carbonic acid gas dissolving apparatus used in the present invention, there can also be used an apparatus having a gas diffusion means in which a gas diffusing part composed of a porous body is set at the bottom of a carbonic acid gas dissolving apparatus. The material and form of a porous body with a gas diffusing part may be optionally selected, and preferably is one having a void ratio of 5 to 70 vol %, a volume ratio of the voids present in the porous body itself based on the whole porous body. For further enhancement of the dissolving efficiency for carbonic acid gas, a lower void ratio is suitable, and particularly a void ratio of 5 to 40 vol % is more preferable. When the void ratio is 70 vol % or less, flow control of carbonic acid gas becomes easier, the gas flow rate can be suitably decreased, bubbles from the carbonic acid gas diffused from a gas diffusing body do not become large, and the dissolution efficiency is not easily lowered. When the void ratio is 5 vol % or more, a sufficient feeding amount of carbonic acid gas can be maintained, and dissolution of the carbonic acid gas tends to be performed in a relatively short time. The opening pore diameter on the surface of a porous body is preferably 0.01 to 10 $\mu$m, for control of the flow rate of diffused carbonic acid gas and for formation of fine bubbles. When the pore diameter is 10 $\mu$m or less, the size of the bubbles rising in the water becomes moderately small, and the dissolution efficiency of the carbonic acid gas increases. When the diameter is 0.01 $\mu$m or more, the amount of gas diffusion in the water increases moderately, and even in the case of obtaining carbonic water with a high concentration, the procedure is completed in a relatively short time.

When a porous body placed in a gas diffusion part of a gas diffusing means has a large surface area, bubbles can be generated in larger numbers, contact between carbonic acid gas and raw water progresses efficiently, and dissolution before formation of bubbles also occurs, leading to an enhanced dissolution efficiency. Therefore, though the form of a porous body is not specified, one having a larger surface area is preferable. As a means of increasing the surface area, there are envisaged various methods such as formation of a porous body in the form of a cylinder, formation of a porous body in the form of a flat plate, and providing irregularity on its surface, and the like, however, it is preferable to use a porous hollow fiber membrane, particularly, utilization of many porous hollow fiber membranes bundled together is effective.

The material used as a porous body is not particularly restricted though various materials such as metals, ceramics and plastics are exemplified. However, hydrophilic materials are not preferable since hot water invades the gas diffusing means through the pores on its surface and stops the feed of carbonic acid gas.

In the case of feeding carbonic acid gas to the outer surface side of a hollow fiber membrane and feeding hot water to the hollow side to dissolve the carbonic acid gas, piping for counterflow washing may be provided. When scale accumulates at a potting opening end, which is a feeding port to the hollow part of the hollow fiber membrane, this scale can be removed relatively simply by counterflow washing.

Regarding the carbonic water produced, its concentration of carbonic acid gas is not particularly restricted. In the above-described example, if the value of a desired concentration of carbonic acid gas is input into the apparatus and the hot water in the bath (11) is circulated by using the circulation pump (1), then, the apparatus controls the circulation time automatically depending on the desired concentration of carbonic acid gas, and consequently, carbonic water having the desired concentration of carbonic acid gas is filled in the bath (11).

However, in general, to obtain medical physiological effects, the concentration of the carbonic acid gas in the carbonic water is required to be at 600 mg/L or more. From this standpoint, the concentration of carbonic acid gas in the carbonic water produced in the present invention is also preferably 600 mg/L or more. On the other hand, when the concentration of carbonic acid gas is higher, the dissolution efficiency of the carbonic acid gas is lower, and additionally, at a certain concentration and above, the physiological effects do not increase or decrease. From this standpoint, the upper limit of the concentration of carbonic acid gas is adequately about 1400 mg/L.

In the carbonic water production apparatus, a bubble generation apparatus or an injection apparatus can be further provided. The bubble generation apparatus generates bubbles in the bath water, and the injection apparatus generates water current in the bath water, to impart physical stimulation to a diseased part of the body, and owing to its massage effect, to promote blood circulation and to attenuate lower back pain, shoulder leaning, muscular fatigue and the like. Such an apparatus is marketed currently by companies, and used widely in hospitals, senile health facilities and homes.

On the other hand, the carbonic water produced in the present invention performs an action in which the carbonic acid gas in water is absorbed percutaneously to dilate blood vessels and promote blood circulation. Namely, if an action by bubble and injection is called a dynamic action, an action by carbonic water can be called a static action. Treatment by carbonic water has a merit in that no stiff load is applied to the body and a diseased part, and little side effect is exerted since it causes no physical stimulation as compared with the bubble generation apparatus and injection apparatus.

In the example shown in FIG. 1, a bubble generating apparatus is further provided with a carbonic water production apparatus according to the first present invention to form one united package which is a multi-functional apparatus capable of carrying out both functions in one apparatus. The bubble generation apparatus comprises, at least, a gas diffusion plate (9) placed at the lower part of a bath in use, a compressor (8) for feeding air to this gas diffusion plate (9), and piping connecting both of them. By activating the compressor (8), bubbles develops from the gas diffusion plate (9), and a physical stimulation is imparted to a diseased part of a man who is taking a bath.

However, in such a multi-functional apparatus, when a bath is filled with carbonic water, it is recommended that bubbles are not generated. The reason for this is that the content of a bath is stirred by bubbles, carbonic acid gas that is dissolved in carbonic water easily evaporates into the air, and the concentration of carbonic water tends to decrease sharply in almost less than no time. Therefore, it is preferable that a carbonic water production function and a bubble generation function are not used simultaneously, and a change switch is provided and these functions are carried out separately.

Figure 3:
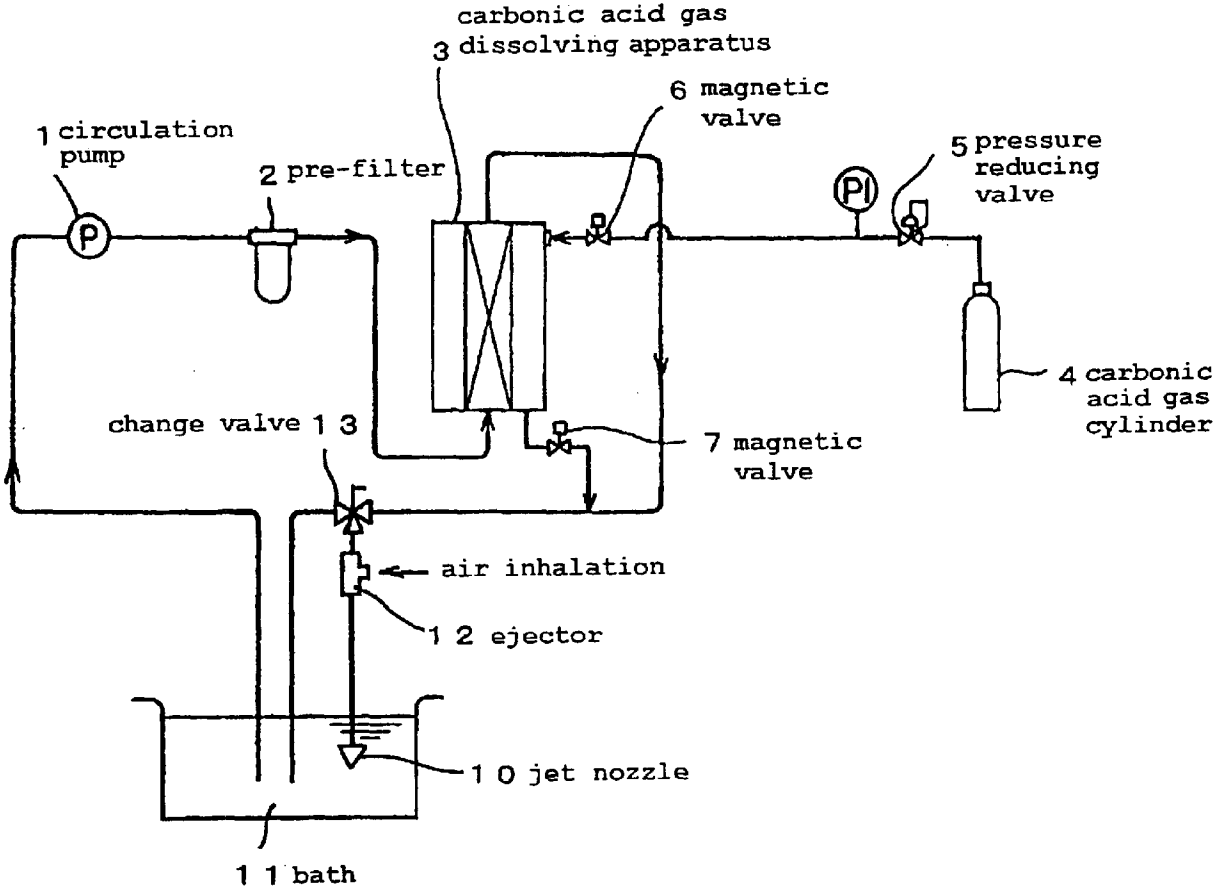
FIG. 3 is a flow sheet showing one example of a circulation type carbonic water production apparatus according to the first present invention.

FIG. 3 shows one example of another multi-functional apparatus in a carbonic water production apparatus according to the first present invention. This injection apparatus is composed of, at least, a jet nozzle (10) placed in a bath (11) in use, an ejector (12) absorbing air fed to the jet nozzle (10), and piping connecting them. Water current, bubbles or the like develops from this jet nozzle (10) and imparts a physical stimulation to a diseased part of a man taking a bath. This water current or bubble generation function is not used together with production of carbonic water, and they are carried out separately by switching a switch valve (13).

In the apparatus shown in FIG. 1, an automatic water extraction means is further provided. This automatic water extraction means is composed, specifically, of piping for extracting excess water from the hollow fiber membrane in the carbonic acid gas dissolving apparatus (3) and a magnetic valve (open valve) (7) placed along the piping. In the carbonic acid gas dissolving apparatus (3), water vapor evaporated from the hollow part of the hollow fiber membrane is condensed on the outside part of the hollow fiber membrane and collects excess water, and this excess water clogs the membrane surface and prevents effective gas permeation from being effected in some cases. The automatic water extracting means opens the magnetic valve (open valve) (7) automatically and periodically, and discharges the excess water collected in the carbonic acid gas dissolving apparatus (3) out of the apparatus.

In the example shown in FIG. 1, for example, in the carbonic acid gas dissolving apparatus (3) (hollow fiber membrane area: 0.6 $m^2$) the magnetic valve (7) is opened for 1 second in initiation of the operation (or in completion), and excess water is discharged out. In this procedure, a carbonic acid gas magnetic valve (6) is opened, and excess water is discharged under suitable gas pressure (about 0.15 MPa). Discharging out at each operation provides excess frequency, leading to waste of carbonic acid gas. Therefore, the operation time is integrated, and after each operation of 4 hours or more, automatic water extraction is conducted at the initiation of the next operation.

Thus, by setting the gas pressure and the time corresponding to the apparatus and conducting excess water extraction automatically, there is no need to manually drain the excess water purposely as in conventional technologies, and usually, effective membrane surface area is confirmed, and carbonic water having a high concentration can be produced.

Figure 5:
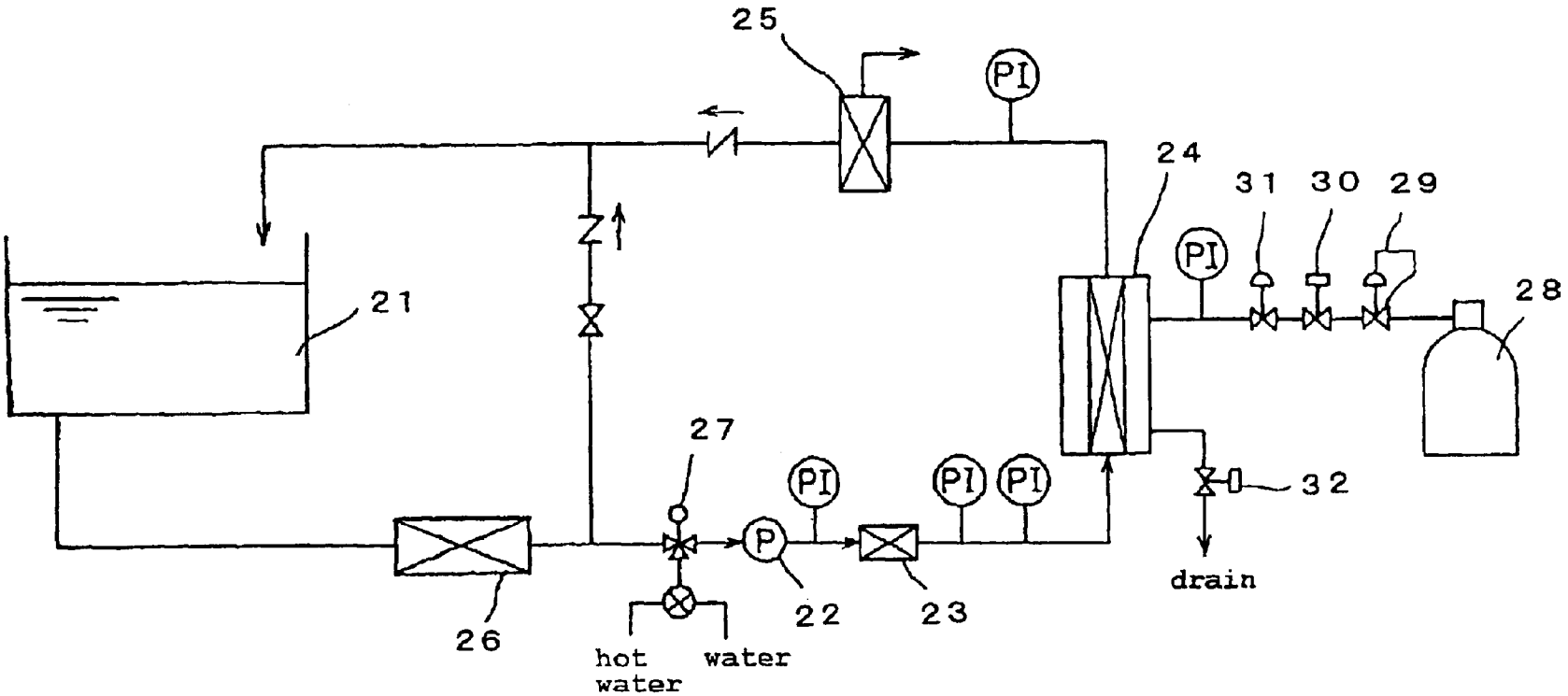
FIG. 5 is a flow sheet showing one example of a circulation type carbonic water production apparatus according to the second present invention.

FIG. 5 is a flow sheet showing one example of a circulation type carbonic water production apparatus according to the second present invention.

First, an initial step in the second present invention will be explained. In this initial step, hot water in a bath (water tank) (21) is circulated. The temperature and application of water in the bath (21) in the second present invention are the same as in the first invention described above. In the example shown in FIG. 5, hot water in this bath (21) is sucked up by a circulation pump (22), and introduced into a carbonic acid gas dissolving apparatus (24) via a pre-filter (23) for trapping debris from the hot water, and returned again to the bath (21) through a gas extraction chamber (25). Between the bath (21) and the circulation pump (22), a filtration apparatus (26) for purifying water in the bath is provided, and additionally, a switching valve (27) through which water and hot water are fed is provided. Carbonic acid gas is fed from a carbonic acid gas cylinder (28), via a pressure-reducing valve (29), a magnetic valve (30), which is a cut off valve for carbonic acid gas and a pressure controlling valve (31), into a carbonic acid gas dissolving apparatus (24).

The circulation pump (22), in the second embodiment of the present invention, is not particularly restricted, and a swirling pump, a diaphragm pump, a screw pump, a tube pump and a piston pump are commonly used, and are listed. The pressure of carbonic acid gas fed to the carbonic acid gas dissolving apparatus (24) is set by the pressure-reducing valve (29). When this pressure is lower, generation of a non-dissolved gas is suppressed, leading to enhanced dissolution efficiency. The carbonic acid gas permeation amount through a hollow fiber membrane in the carbonic acid gas dissolving apparatus (24) is in proportion to the feeding pressure of the carbonic acid gas, and when the pressure is higher, the permeation amount is also higher. The carbonic acid gas absorption amount of the circulating hot water depends also upon the concentration of carbonic acid gas and the circulation amount of hot water. When carbonic acid gas is fed over the absorption amount, a non-dissolved gas is formed.

Regarding the carbonic water produced in the initial step, its concentration of carbonic acid gas is not particularly restricted. Hot water in the bath (21) increases in concentration of carbonic acid gas with the lapse of circulation time. When such correlation data between the circulation time and the concentration of carbonic acid gas are measured, and the intended concentration of carbonic acid gas and the feed pressure of the carbonic acid gas are known, the necessary circulation time can be determined.

The preferable concentration of carbonic acid gas in carbonic water the configuration of the carbonic acid gas dissolving apparatus (24), the configuration of the membrane module, the configuration of the hollow fiber membrane, the preferable range of the feed pressure for carbonic acid gas, the piping for counterflow washing, and the automatic water extraction means (piping to drain the excess water, and magnetic valve (open valve) (32) are the same as in the case of the first invention (FIG. 1).

Using the circulation type carbonic water production process described above, namely, the initial step in the second present invention, carbonic water having high concentrations (for example, 600 mg/L to 1400 mg/L) can be produced efficiently. The length of time for this initial step is not particularly restricted, and the initial step may be effected until carbonic water having the desired concentration of carbonic acid gas is filled in the bath. Usually, it is necessary to heat the water until the bath reaches a suitable temperature. Before use of the bath, however, it is preferable that the length of time for the initial step in the second present invention is also about the same as its heating time. This heating time is about 1 hour in the case of a large bath for a large number of people.

The feed pressure of carbonic acid gas in the initial step is preferably about 0.15 MPa to 0.3 MPa. Values around the lower limit of this pressure are values particularly suitable in the case of a small bath, and values around the upper limit are values particularly suitable in the case of a large bath. In the initial step, the carbonic acid gas pressure can also be increased to produce carbonic water with a high concentration in a short period of time, however, in the concentration maintaining step a lower pressure than this can be adopted.

Following this initial step, hot water in the bath is further circulated continuously and its high concentration is maintained efficiently, namely, this is the concentration maintaining step of the second present invention. This concentration maintaining step is significant particularly in the case of a large bath having a large surface area on the water surface. The length of time of this concentration maintaining step is not particularly restricted, however, it is preferable that the concentration maintaining step is conducted during use of the bath. Furthermore, the concentration maintaining step may be effected continuously during use of a bath, or may be effected intermittently at an interval provided that the concentration of carbonic acid gas in carbonic water in a bath can be maintained at a desired value (for example, 600 mg/L to 1400 mg/L). Since carbonic acid gas in carbonic water usually evaporates at a rate of about 1 to 4 mg/L/$cm^2$/Hr per bath area, it may be recommended that carbonic acid gas in an amount approximately equal to its evaporation rate is fed and dissolved in the carbonic water.

The feed pressure for carbonic acid gas in the concentration maintaining step is preferably about 0.001 to 0.1 MPa. Values around the lower limit of this pressure are values particularly suitable in the case of a small bath, and values around the upper limit are values particularly suitable in the case of a large bath.

In the second present invention, the size of a bath (water tank) is not particularly restricted, however, a bath having an internal volume of about 0.5 $m^3$ to 3 $m^3$ can be used.

The circulation flow rate per unit area of the concentration maintaining step in the initial step is preferably about 5 L/min/$m^2$ to 15 L/min/$m^2$. The carbonic acid gas permeation flow rate per unit membrane area in a hollow fiber membrane is preferably about 0.2 to 2 L/min/atm/$m^2$.

[Embodiments of the Third Present Invention]

Figure 6:
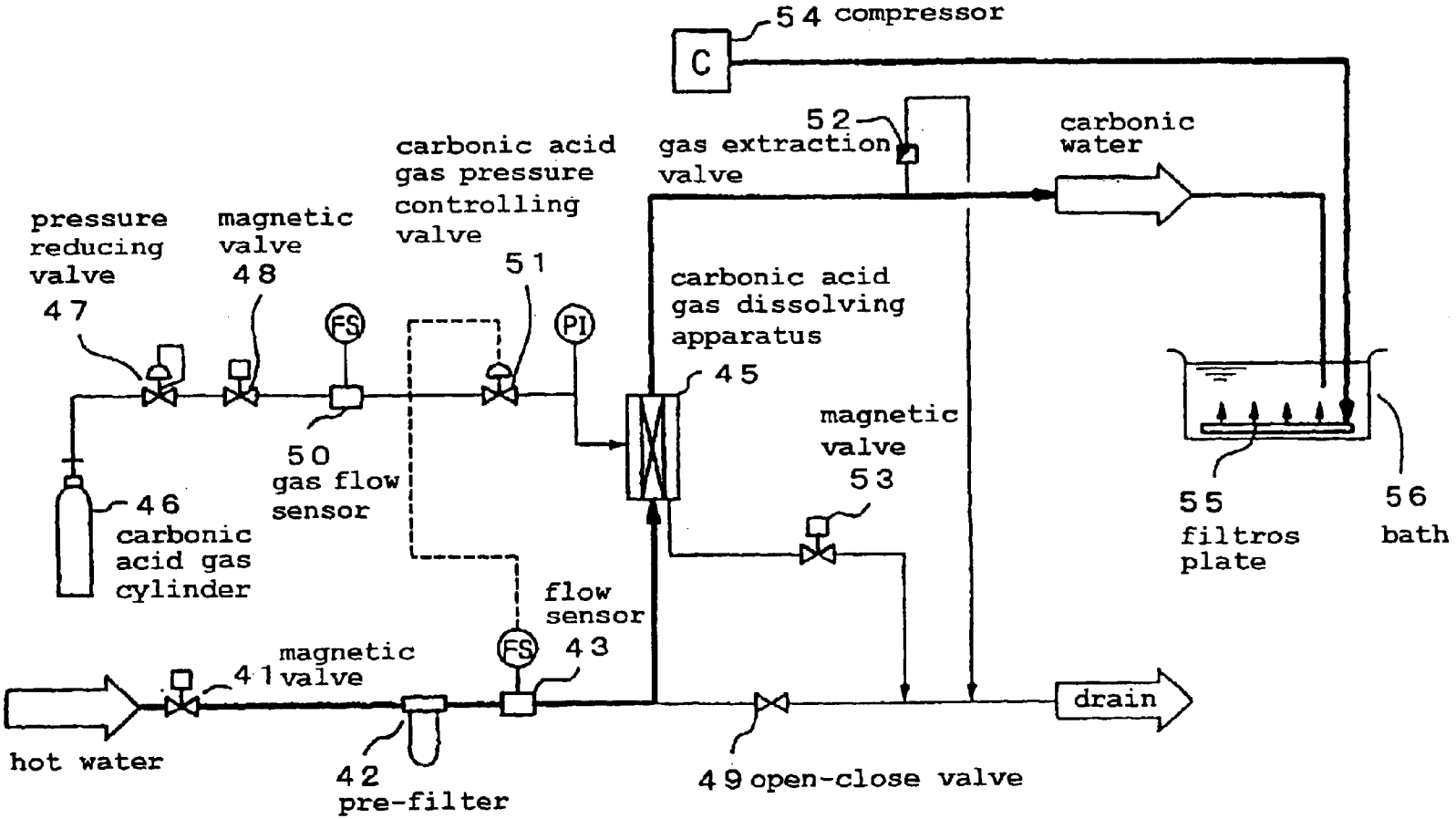
FIG. 6 is a flow sheet showing one example of a one-pass type carbonic water production apparatus according to the third present invention.

FIG. 6 is a flow sheet showing one example of a one-pass type carbonic water production apparatus according to the third present invention. In this example, hot water directly fed from a hot water faucet of a general water line and the like is used as raw water. In the third present invention, the temperature and application of water in a bath are the same as in the first invention described above. The hot water is introduced into a carbonic acid gas dissolving apparatus (45) via a magnetic valve (41) which is a cut off valve for raw water feeding, a pre-filter (42) for trapping debris from the hot water and a flow sensor (43) detecting the flow rate of the hot water. The carbonic acid gas is fed from a carbonic acid gas cylinder (46), via a pressure-reducing valve (47), a magnetic valve (48) which is a cut off valve for the carbonic acid gas, a gas flow sensor (50), and a carbonic acid gas pressure controlling valve (51) for controlling the carbonic acid gas pressure, into a carbonic acid gas dissolving apparatus (45). When excess gas flows by gas leaking into the piping and the carbonic acid gas dissolving apparatus (45), the magnetic valve (48) is cut off. An apparatus for producing carbonic water by passing raw water through the carbonic acid gas dissolving apparatus (45) once is called a one-pass type apparatus as illustrated above.

In this example, hot water is fed continuously into the hollow part of the hollow fiber membrane in the carbonic acid gas dissolving apparatus (45). By passing through the carbonic acid gas dissolving apparatus (45), raw water becomes carbonic water, and this carbonic water is fed continuously from the carbonic acid gas dissolving apparatus (45) to a bath (56) through the piping. The flow rate of the raw water fed into the carbonic acid gas dissolving apparatus (45) (namely, flow rate of raw water passing in the dissolving apparatus (45) can be detected by a flow sensor (43) provided before feeding raw water into the carbonic acid gas dissolving apparatus (45).

Figure 7:
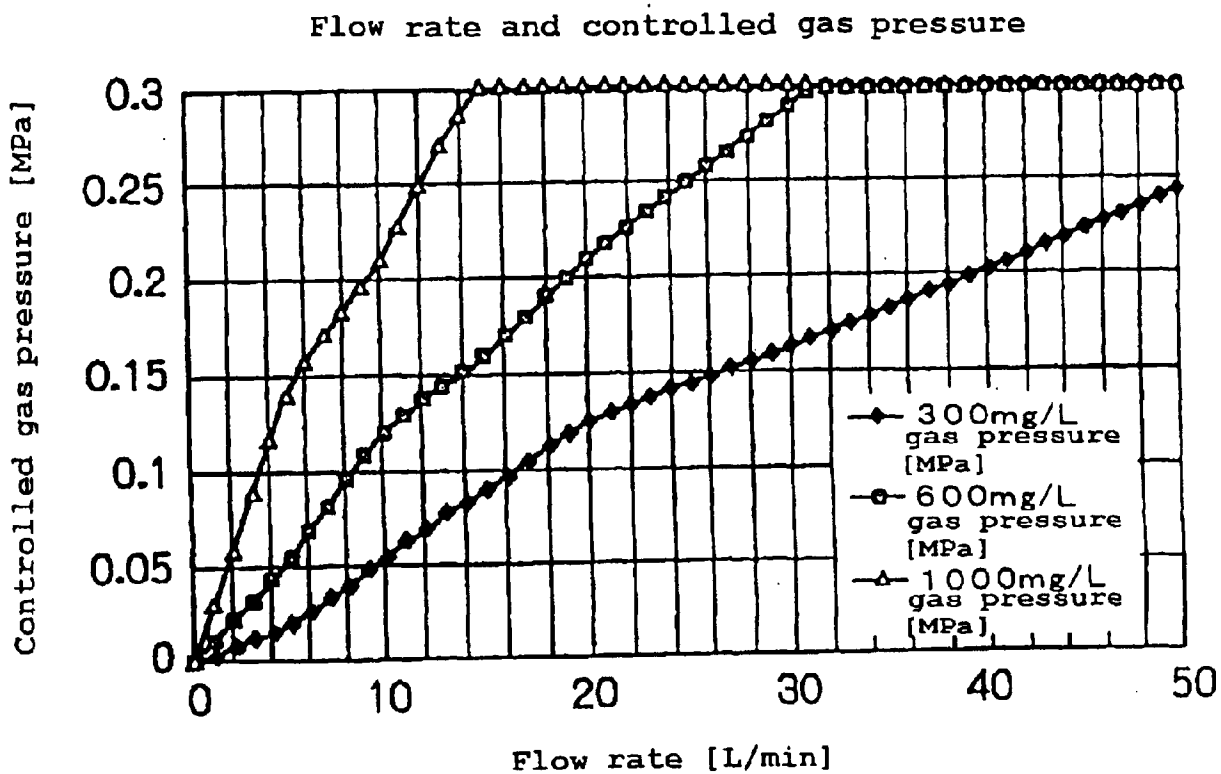
FIG. 7 is a graph showing a correlation between the flow rate of raw water and the controlled gas pressure of carbonic acid gas in the third present invention.

FIG. 7 is a graph showing a correlation between the flow rate [L/min] of raw water fed into the carbonic acid gas dissolving apparatus (45) (hollow fiber membrane area: 2.4 $m^2$) and the controlled gas pressure [MPa] of carbonic acid gas. In this FIG. 7, a correlation between the flow rate of raw water and the controlled gas pressure of carbonic acid gas is shown when the concentration of carbonic acid gas of the resulting carbonic water is 300 mg/L, 600 mg/L and 1000 mg/L. For example, when the feed pressure of carbonic acid gas is raised, the carbonic acid gas permeation amount in a hollow fiber membrane in the carbonic acid gas dissolving apparatus (45) increases in proportion to this pressure. Therefore, when the flow rate of raw water is large or when the concentration of carbonic acid gas intended is high, the feeding pressure of carbonic acid gas may advantageously be increased correspondingly.

In the third present invention, the correlation as shown in FIG. 7 is stored as a datum and, for example, programmed into a control computer for the apparatus. This datum is used in the following manner. First, a user inputs the intended concentration of carbonic acid gas in carbonic water to be obtained, for example, 1000 mg/L, in the apparatus. Then, hot water is fed into the apparatus from a hot water faucet of a general waterline. The flow rate of hot water is an indefinite factor that is always changing depending on the extent of opening the faucet. Therefore, this apparatus detects the flow rate which is an indefinite factor in real time by a flow sensor (43). Based on the graph of the correlation (relative data) shown in FIG. 7, the pressure of carbonic acid gas needed to obtain carbonic water having a concentration of carbonic acid gas of 1000 mg/L is derived, and the feed pressure of carbonic acid gas fed to the carbonic acid gas dissolving apparatus (45) is automatically controlled by a carbonic acid gas pressure controlling valve (51). Namely, a program may advantageously be made so that, based on the flow rate of raw water detected by the flow sensor (43) and the relative data recorded previously, a necessary feed pressure of carbonic acid gas is determined, and the feed pressure of carbonic acid gas is automatically controlled by a carbonic acid gas pressure controlling valve (51) to reach the determined pressure value.

Regarding a hollow fiber membrane, in general, if the maximum value of the flow rate of raw water is hypothesized at about 30 L/min, the feed pressure of carbonic acid gas is controlled in the range of 0.01 to 0.5 MPa, and the membrane area of a hollow fiber membrane is adequately from about 0.1 $m^2$ to 15 $m^2$.

In the third present invention, for example, even in the case of feeding raw water from a faucet (namely, when the flow rate of raw water is indefinite), the intended concentration of carbonic acid gas can be obtained with little error. Additionally, since a concentration of carbonic acid gas measuring means and a pH measuring means as used in conventional technologies are not necessary, the apparatus becomes compact and operation thereof is simple. Therefore, for example, provision for a carbonic water production apparatus is not necessarily required in a step of designing a bath, and a compact apparatus simply corresponding to known baths including a domestic bath can be obtained, very practically.

The correlation shown in FIG. 7 is also affected by a gas-liquid contact area (e.g., hollow fiber membrane area). However, in a gas-liquid contact means such as a membrane module used in the apparatus, the gas-liquid contact area is constant. Even if a part is changed, the same product defined as the standard article of the apparatus is usually used. Namely, in an individual apparatus, usually the gas-liquid contact area is a constant factor. Therefore, the correlation shown in FIG. 7 will take single meaning in one apparatus.

When a hollow fiber membrane is used in the carbonic acid gas dissolving apparatus (45), the thickness of the hollow fiber membrane is preferably from 10 to 150 $\mu$m. When the membrane thickness is 10 $\mu$m or more, sufficient membrane strength tends to be shown. When the thickness is 150 $\mu$m or less, sufficient carbonic acid gas permeation speed and dissolution efficiency are liable to be shown. In the case of the three-layer complex hollow fiber membrane, the thickness of a non-porous membrane is preferably from 0.3 to 2 $\mu$m. When 0.3 $\mu$m or more, the membrane does not easily deteriorate, and leakage due to membrane deterioration does not occur easily. When 2 $\mu$m or less, sufficient carbonic acid gas permeation speed and dissolving efficiency are liable to be shown.

Characteristics other than the thickness of a hollow fiber membrane, such as preferable concentrations of carbonic acid gas in carbonic water, the configuration of the carbonic acid gas dissolving apparatus (45), the configuration of a membrane module, the piping for counterflow washing, the automatic water extraction means (piping to drain excess water, and magnetic valve (open valve) (53), and the bubble generating apparatus and injection apparatus are the same as in the case of the first invention (FIG. 1).

In the apparatus shown in FIG. 6, a gas extraction valve (52) is provided at the down flow side of the carbonic acid gas dissolving apparatus (45), namely, the side of piping through which the produced carbonic water flows. This gas extraction valve (52) communicates with a discharge tube, and removes non-dissolved carbonic acid gas in the form of bubbles contained in the carbonic water, and discharges this gas to a drain pipe.

[Embodiments of the Fourth Present Invention]

As the embodiment of the fourth present invention, namely, a carbonic water production apparatus having an automatic water extraction means, which automatically discharges excess water (or drains the water) collected in a membrane type carbonic acid gas dissolving apparatus, is mentioned such as, for example a configuration of the one-pass type carbonic water production apparatus shown in FIG. 6, as explained previously as the embodiment of the third present invention. However, in the fourth present invention, a means of controlling the feed pressure of carbonic acid gas as described in the third present invention is not necessarily required. Except for these points, configurations as described in FIG. 6 can be adopted.

In the apparatus shown in FIG. 6, an automatic water extraction means is provided. This automatic water extraction means is composed, specifically, of piping for extracting excess water and communicating with the outer side of the hollow fiber membrane in the carbonic acid gas dissolving apparatus (45) with a magnetic valve (open valve) (53) placed along the piping. In the carbonic acid gas dissolving apparatus (45), water vapor evaporated from the hollow part of the hollow fiber membrane is condensed on the outside part of the hollow fiber membrane and collects excess water, and this excess water clogs the membrane surface and prevents effective gas permeation from being effected in some cases. The automatic water extracting means opens the magnetic valve (open valve) (53) automatically and periodically, and discharges (or drains) the excess water collected in the carbonic acid gas dissolving apparatus (45) out of the apparatus. In the example shown in FIG. 6, for example, a setting is made so that when the flow rate of raw water detected by the flow sensor (43) is 1 L/min or less, the magnetic valve (48) closes to stop feeding of carbonic acid gas, and as a result, production of carbonic water is stopped. The setting is made so that, after feeding of carbonic acid gas is thus stopped, given a certain time lapse, then the excess water is automatically extracted and drained. Specifically, 10 seconds after this stopping time, the magnetic valve (53) is opened for about 5 seconds, and the excess water is discharged by the remaining gas pressure in the hollow fiber membrane.

The carbonic acid gas dissolving apparatus may have a configuration in which carbonic acid gas is fed into the hollow fiber membrane and raw water is fed into the outside of the hollow fiber membrane, contrary to the above-mentioned configuration. In the case of such a configuration, the drain piping is connected to the inside of the hollow fiber membrane in the carbonic acid gas dissolving apparatus.

In stopping the feed of carbonic acid gas, there is a possibility that a high pressure of 0.3 MPa at its maximum remains in the outside of the hollow fiber membrane in the carbonic acid gas dissolving apparatus (45). Therefore, if the magnetic valve (53) is opened immediately after stopping the feed of carbonic acid gas, a hammer phenomenon may occur. To prevent this, a time lag (about 10 seconds) is provided in the above-mentioned example. When about 10 seconds elapses, gas outside of the hollow fiber membrane permeates appropriately into the hollow side via the membrane, and the remaining pressure outside of the hollow fiber membrane becomes about 0.05 Mpa. At such a remaining pressure, a hammer phenomenon does not occur, and excess water can be discharged sufficiently by opening the magnetic valve (53) for about 5 seconds.

In a carbonic water production apparatus, of feeding raw water and carbonic acid gas are fed into a membrane type carbonic acid gas dissolving apparatus (45) to dissolve carbonic acid gas into raw water as shown in FIG. 6. During feeding a setting is made such that in stopping the feed of carbonic acid gas, after a lapse of time (lag time) in which the remaining pressure outside of the hollow fiber membrane in the carbonic acid gas dissolving apparatus (45) permeates to the hollow side to a certain extent and excess water can be appropriately discharged or drained, the valve is opened for a sufficient period of time for extracting the excess water automatically. This time lag may be advantageously set so that the remaining pressure is at about 0.02 to 0.05 MPa, or preferably at about 0.02 to 0.03 Mpa. Specifically, a suitable time lag is about 5 to 10 seconds. The duration of time that the magnetic valve (53) is opened is from about 3 to 5 seconds.

Furthermore, another embodiment of the fourth present invention is, for example, a configuration of the circulation type carbonic water production apparatus shown in FIG. 1 explained previously as the embodiment of the first present invention. However, in the fourth present invention, a positive displacement metering pump with self-priming ability as in the first present invention is not necessarily required. Except for these points, configurations as described in FIG. 1 can be adopted.

Namely, in the apparatus shown in FIG. 1, the automatic water extraction means is composed, specifically, of piping for extracting excess water in from a hollow fiber membrane in the carbonic acid gas dissolving apparatus (3) and a magnetic valve (open valve) (7) placed along the piping. This automatic water extracting means opens the magnetic valve (open valve) (7) automatically and periodically, and discharges the excess water collected in the carbonic acid gas dissolving apparatus (3) out of the apparatus. For example, in the carbonic acid gas dissolving apparatus (3) (hollow fiber membrane area: 0.6 $m^2$), the magnetic valve (7) is opened for 1 second in the beginning of the operation (or in completion), and excess water is discharged out. In this procedure, a carbonic acid gas magnetic valve (6) is opened, and excess water is discharged under suitable gas pressure (about 0.15 Mpa). Discharging out at each operation provides excess frequency, leading to waste of carbonic acid gas. Therefore, the operation time is integrated, and after each operation of 4 hours or more, automatic water extraction is conducted at the beginning of the next operation.

In a carbonic water production apparatus as shown in FIG. 1 (circulation type) of circulating water in the bath (11) (water tank) via the carbonic acid gas dissolving apparatus (3) by a circulation pump (1) and feeding carbonic acid gas into the carbonic acid gas dissolving apparatus (3) to dissolve the carbonic acid gas into the water, a setting is made such that, at initiation or completion of the operation, the valve is opened for a sufficient amount of time for extracting excess water automatically, while supplying a suitable pressure for extracting excess water from the carbonic acid gas feeding tube. This suitable pressure is preferably about 0.03 to 0.15 MPa. A suitable duration of time for opening the magnetic valve (7) is about 1 to 5 seconds. Furthermore, a setting may advantageously be made so that the operation time of the carbonic acid gas dissolving apparatus (3) and the drain excess water remaining are recorded as data, and the length of time requiring excess water extraction (integrated operation time) is determined, and the operation time is automatically integrated into the apparatus, and after each operation for the determined integrated operation time, automatic water extraction is conducted at the beginning of the next operation. This integrated operation time is preferably about 4 to 6 hours.

Thus, by setting the time and the remaining pressure corresponding to the apparatus and conducting excess water extraction automatically, there is no necessity to effect manual drainage or excess water extraction purposely as in conventional technologies, and usually, effective membrane surface area is confirmed, and carbonic water of high concentration can be produced easily.

[Embodiments of Feeding to a Plurality of Use Points in the First to the Fourth Present Inventions]

In the first through fourth present inventions described above, another useful embodiment is an application as an apparatus in which a carbonic water production apparatus and a water storage tank are provided, carbonic water produced in the carbonic water production apparatus is stored in the water storage tank, and carbonic water stored in the water storage tank is fed to a plurality of use points by a water conveying pump.

In conventional carbonic water production, it is usual for one carbonic water production apparatus to be used for one use point (e.g., bath). Therefore, in facilities like hospitals and sanatoriums having many use points, a carbonic water production apparatus must be provided for each use point, leading to increased equipment cost. Furthermore, use of one carbonic water production apparatus per each use point means that when a large amount of carbonic water is needed at a time for the use point, the dissolving apparatus and the like for the carbonic water production apparatus must be enlarged. On the other hand, in the case of application to a carbonic water production feeding system having separate functions to produce carbonic water and to store water, together as described above (carbonic water production apparatus), even if carbonic water is fed to a plurality of use points, one carbonic water production apparatus can act satisfactorily, leading to a reduction in equipment cost.

Figure 8:
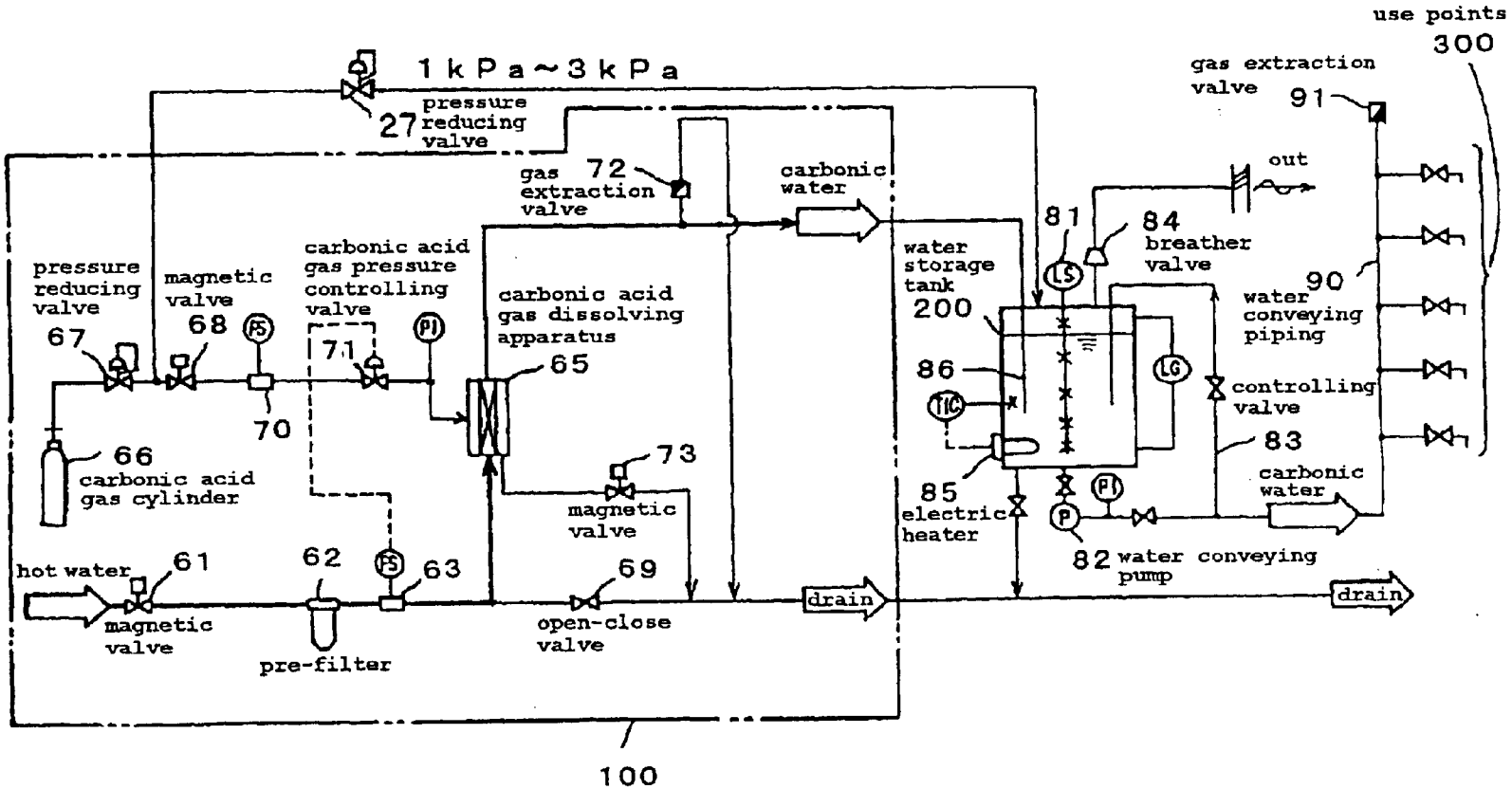
FIG. 8 is a flow sheet schematically showing one example of application to a carbonic water production and feeding system.

FIG. 8 is a flow sheet schematically showing one example of this embodiment. This apparatus comprises a carbonic water production apparatus (100) and a water storage tank (200) as the basic elements. The carbonic water production apparatus (100) is a one-pass type apparatus, and in this example, hot water directly fed from a hot water faucet from a general water line and the like is used as raw water. This hot water is introduced into the carbonic acid gas dissolving apparatus (65) via a magnetic valve (61) which is a cut off valve for the raw water feeding, a pre-filter (62) for trapping debris from the hot water and a flow sensor (63) detecting the flow rate of hot water. On the other hand, carbonic acid gas is fed from a carbonic acid gas cylinder (66), via a pressure-reducing valve (67), a magnetic valve (68) which is a cut off valve for the carbonic acid gas, a gas flow sensor (70) and a carbonic acid gas pressure controlling valve (71) for controlling the carbonic acid gas pressure, into a carbonic acid gas dissolving apparatus (65). It also has an automatic water extraction means (a drain or excess water extraction piping, and a magnetic valve (opening valve)(73) placed along the piping) and a gas extraction valve (72).

Next, the water storage tank (200) and the use points (300) are described.

Carbonic water having a high concentration (about 1000 mg/L) and produced in the above-mentioned carbonic water production apparatus (100) is fed to the water storage tank (200) through piping. A feeding tube (86) for feeding the produced carbonic water to the water storage tank (200) is placed as an insertion tube in the water storage tank (200). By this, stirring of carbonic water can be prevented as completely as possible and the evaporation of carbonic acid gas in the carbonic water can be prevented. When water in the water storage tank (200) reaches a given water level, carbonic water production in the carbonic water production apparatus (100) is stopped by a level switch (81).

Next, carbonic water is fed centrally to the use points (300) by a water conveying pump (82). A gas extraction valve (91) is mounted on the uppermost part of a water conveying tube (90), to remove the evaporated carbonic acid gas.

Examples of commonly used water conveying pumps (82) include a swirling pump, a diaphragm pump, a screw pump, a tube pump and a piston pump. To aid in driving the water conveying pump (82), return piping (83) is provided for constant circulation, to prevent shutoff of the water conveying pump (82), and to control the water conveying flow rate. A part of this return piping (83), which re-conveys water to the water storage tank (200), is placed as an insertion tube like the feeding tube (86) used for feeding carbonic water to the water storage tank (200), and is used to prevent stirring of carbonic water as much as possible.

Here, if the water storage tank (200) is an open system, there is a tendency that the carbonic acid gas in the carbonic water vaporized to lower the concentration. Therefore, for maintaining high concentrations of carbonic water in the water storage tank (200), it is preferable that a gas phase part in the tank is always filled with carbonic acid gas. In the example shown in FIG. 8, carbonic acid gas of about 1 kPa to 3 kPa is sealed and pressed as a gas phase in the water storage tank (200) via a pressure-reducing valve (67) from a carbonic acid gas cylinder (66). According to this configuration, when the water level of carbonic water in the water storage tank (200) drops, carbonic acid gas is fed into the gas phase, and when the water level rises, discharge is effected through a breather valve (84).

The water storage tank (200) has an electric heater (85) which maintains the temperature of carbonic water at a given temperature. The electric heater (85) is turned on or off by a controller.

In the water storage tank (200), if the gas pressure in the gas phase and the temperature of carbonic water are determined, the dissolution degree of carbonic acid gas in water is constant, and therefore, the carbonic water that is always maintained at a constant concentration can be stored in the water storage tank (200). For example, when a gas phase is composed of 100% carbonic acid gas under atmospheric pressure, the dissolution degree of carbonic acid gas in water (40° C.) is chemically 1109 mg/L (40° C.). Therefore, the concentration of carbonic acid gas in carbonic water can be kept at a high concentration of 1000 mg/L or more only by maintaining a gas phase (carbonic acid gas) at atmospheric pressure, additionally, if the atmosphere in the water storage tank (200) is maintained at or around the atmospheric pressure, extreme positive pressure or negative pressure is not applied on the walls of the water storage tank (200), therefore, the structural material of the water storage tank (200) may be made of a relatively light material, leading to reduction in equipment cost.

In this embodiment, water fed to the water storage tank (200) should be carbonic water of a desired concentration. If water containing utterly no carbonic acid gas is fed to the water storage tank (200), for example, it is necessary to carry out a conventional method (pressured method) in which pressure sealing is effected in the water storage tank (200) under high pressure, to produce a carbonic acid gas, however, in this case, the water storage tank (200) is enlarged and a longer period of time is necessary for production of carbonic water, therefore, stable feeding to the use points cannot be performed. Additionally, it is also difficult to obtain carbonic water having a desired high concentration.

Figure 9:
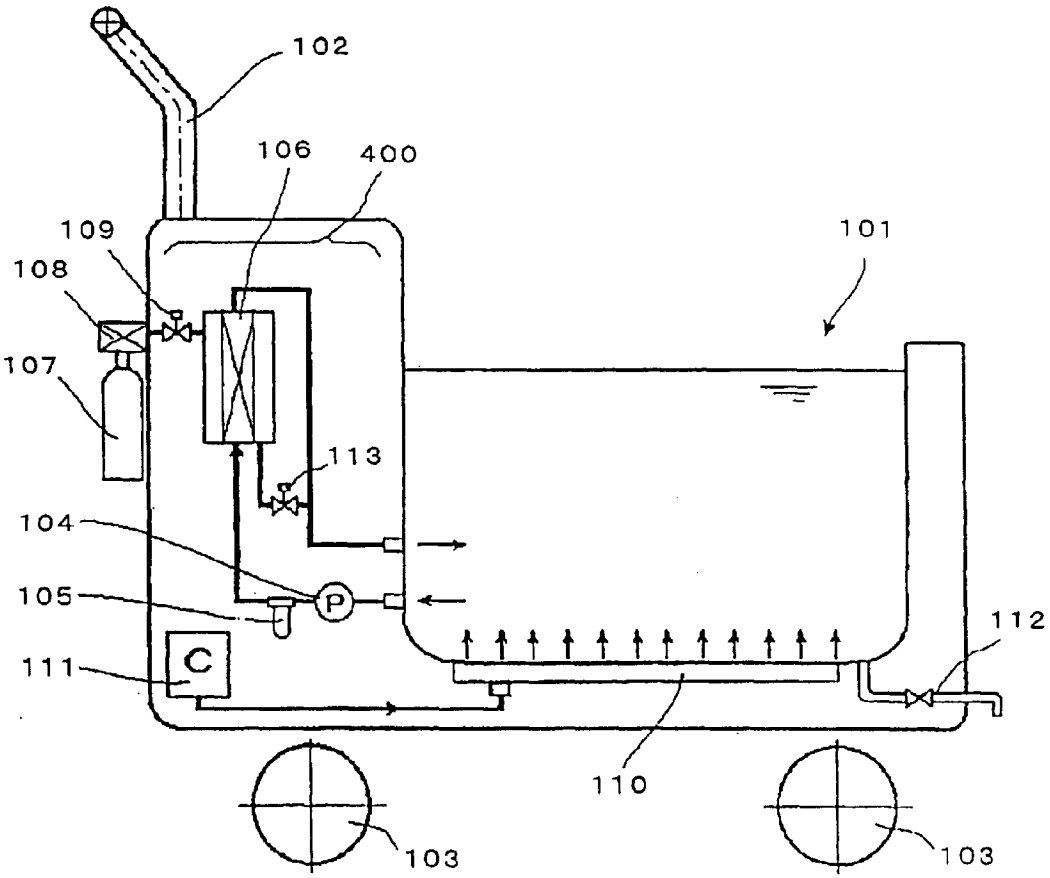
FIG. 9 is a schematic view showing one embodiment of the fifth present invention utilizing a circulation type carbonic water production apparatus.

FIG. 9 is a schematic view showing one embodiment of the fifth present invention using a circulation type carbonic water production apparatus (400). This apparatus contains a carbonic water production apparatus (400) at the posterior side of a bath (101). On its posterior upper side, a handle (102) is mounted, and casters (103) are provided under the body. By using this handle (102) and the casters (103), easy conveyance is possible. In this example, for the carbonic water production apparatus (400) a circulation type apparatus is used, and hot water in a bath (101) is circulated. In the fifth present invention, the temperature of the water in the bath (101) is not particularly restricted. However, temperatures around body temperature or lower are preferable to manifest physiological effects of the carbonic water and not to apply a surplus load on a diseased part. Specifically, temperatures of about 32 to 42° C. are preferable.

In the example shown in FIG. 9, hot water in the bath (101) is absorbed by a circulation pump (104), and introduced into a carbonic acid gas dissolving apparatus (106) via a pre-filter (105) for trapping debris from the hot water and returned again to the bath (101). On the other hand, carbonic acid gas is fed from a carbonic acid gas cylinder (or cartridge) (107), via a pressure-reducing valve (108) and a magnetic valve (109) which is a cut off valve for the carbonic acid gas, into a carbonic acid gas dissolving apparatus (106). The circulation pump (104) is not particularly restricted, and can be, for example, a swirling pump, a positive displacement metering pump and the like, which are commonly used. Since the apparatus according to the fifth present invention is of an integrated type in which the bath itself has a carbonic water production apparatus, the circulation pump (104), for example, can be placed at a position lower than the bottom of the bath. With such a layout, the pump can be activated even if no priming is effected on the pump. Namely, in a circulation type carbonic water production apparatus, a commonly used swirling pump can be used which is also one of the merits of the fifth present invention.

The carbonic acid gas dissolving apparatus (106) is a membrane type carbonic acid gas dissolving apparatus having a membrane module containing a hollow fiber membrane placed in it. In this example, when hot water in the bath (101) is circulated for any amount of time by the circulation pump (104), the bath (101) will be filled with carbonic water having a high concentration of carbonic acid gas. The volume of this bath (101) is usually in the range from 10 to 40 L.

In the case of a foot bath utilizing the circulation type carbonic water production apparatus (400) as shown in FIG. 9, namely, an apparatus which comprises the carbonic acid gas dissolving apparatus (106) and circulation pump (104) in which carbonic acid gas is fed into the carbonic acid gas dissolving apparatus (106) while circulating water in the bath part (101) via the carbonic acid gas dissolving apparatus (106) and the circulation pump (104), and dissolving the carbonic acid gas in water producing carbonic water, a merit is obtained in reduced cost as compared with a foot bath (see, FIG. 10 described later) utilizing a one-pass type carbonic water production apparatus.

Further, in this example, when the amount of water passed per hollow fiber membrane module is 0.1 to 10 L/min and the gas pressure is 0.01 MPa to 0.3 MPa, it is preferable that the membrane area is about 0.1 $m^2$ to 5 $m^2$.

In the foot bath shown in FIG. 9, when carbonic water is produced as described above and the apparatus is used as a foot bath, then the carbonic water used is extracted from the discharge tube (112), and the inner surface of the bath is washed in preparation for the subsequent use. Use of the same carbonic water for a plurality of patients is not preferable due to a possibility of bacterial infection. From the standpoint of shortening the discharge operation time, it is preferable that the internal diameter of the discharge tube (112) is 20 mm or more. In the example shown in FIG. 9, a bubble generation apparatus is mounted to provide one unit package, to give a multi-functional apparatus. The bubble generating apparatus is composed of, at least, a gas diffusing part (110) placed at the lower side of a bath (101), a compressor (111) for feeding air to the gas diffusing part (110), and piping connecting both of them. By activating the compressor (111), bubbles are generated from the gas diffusing part (110), and a physical stimulation is imparted to a diseased part of the patient.

In the example shown in FIG. 9, automatic water extraction means (i.e., piping for discharge of excess water and a magnetic valve (open valve) (113) are further provided. In the case of a circulation type apparatus, it may be recommended that the magnetic valve (113) is opened for 1 second at the beginning of the operation (or in completion), and excess water is discharged out under suitable gas pressure. The preferred concentration of carbonic acid gas in the carbonic water, the configuration of the carbonic acid gas dissolving apparatus (106), the type of membrane module, the configuration of the hollow fiber membrane, the preferred range of the carbonic acid gas feed pressure, the piping for counterflow washing and automatic water extraction means (i.e., piping for discharge of excess water and a magnetic valve (open valve) (113) are all the same as in the case of the first invention (FIG. 1).

Figure 10:
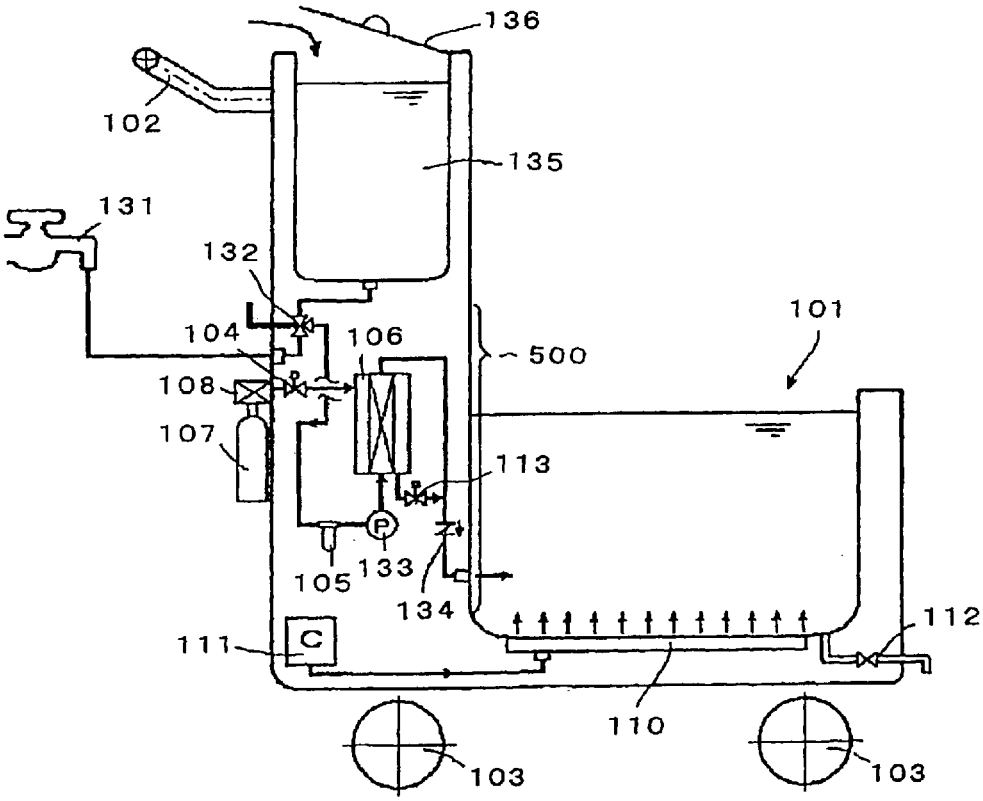
FIG. 10 is a schematic view showing one embodiment of the fifth present invention utilizing a one-pass type carbonic water production apparatus.

FIG. 10 is a schematic view showing one embodiment of the fifth present invention using a one-pass type carbonic water production apparatus (500). In this example, hot water directly fed from a hot water faucet (131) from a general water line and the like is used as raw water. This hot water is introduced into a carbonic acid gas dissolving apparatus (106) via a switching valve (132) for cutting off and switching raw water feeding, a pre-filter (105) for trapping debris from the hot water, and a pump (133). On the other hand, carbonic acid gas is fed from a carbonic acid gas cylinder (or cartridge) (107) via a pressure-reducing valve (108) and a magnetic valve (104), which is a cut off valve for the carbonic acid gas, into a carbonic acid gas dissolving apparatus (106). There is no need to use a special pump as the pump (133) can be, for example, a swirling pump and the like commonly used. However, the pump (133) is not necessarily required in a one-pass type apparatus. Namely, if the desired water pressure is obtained from the use of tap water, and the like, carbonic water can be produced by passing water to the apparatus (500) without using the pump (133). For the carbonic acid gas cylinder (or cartridge)

(107), a small cylinder is preferable from the standpoint of conveyance, and a cylinder (or cartridge) having a volume of 1 L or less is preferable.

Furthermore, instead of using tap water, water stored in a water storage tank (135) provided on the carbonic water production apparatus (500) can also be fed into the carbonic acid gas dissolving apparatus (106) via the switching valve (132). The volume of the water storage tank (135) is the same as that of the bath part (101) of the foot bath, and hot water is collected in the water storage tank (135) in every operation, the entire amount is fed into the bath part (101) via the carbonic water production apparatus (500). With such a function, a foot bath can be used even at a place where there is no water line, and the merit of a portable foot bath can be further utilized. Raw water in the water storage tank (135) has been previously entirely fed in a suitable amount of time by opening the lid (136).

The carbonic acid gas dissolving apparatus (106) is a membrane type carbonic acid gas dissolving apparatus having a membrane module containing a hollow fiber membrane placed in it. In this example, carbonic acid gas fed into the carbonic acid gas dissolving apparatus (106) is introduced onto the outer surface of the hollow fiber membrane. The raw water (hot water) fed into the carbonic acid gas dissolving apparatus (106) flows into the hollow part of the hollow fiber membrane. Here, the carbonic acid gas on the outer surface of the hollow fiber membrane comes into contact with the raw water flowing into the hollow part of the hollow fiber membrane via a membrane surface, and the carbonic acid gas is dissolved into the raw water to produce carbonic water having a desired concentrations in one pass. The carbonic water is then fed into the bath part (101) via a non-return valve.

The carbonic acid gas dissolving apparatus may have a configuration in which carbonic acid gas is fed into a hollow fiber membrane and raw water is fed to the outside of a hollow fiber membrane, contrary to the above-mentioned configuration.

In the case of a foot bath utilizing the one-pass type carbonic water production apparatus (500) as shown in FIG. 10, namely, an apparatus which comprises the carbonic acid gas dissolving apparatus (106) and in which carbonic acid gas is fed into the carbonic acid gas dissolving apparatus (106) from either a raw water feeding port connected to a faucet (131) or a water storage tank (135) while raw water flows dissolving the carbonic acid gas into the water, producing carbonic water, a merit of the apparatus is that microbial infection in the apparatus does not occur easily as compared with a foot bath utilizing the circulation type carbonic water production apparatus (400) shown in FIG. 9. When the one-pass type carbonic water production apparatus (500) is used, the carbonic water production time can be shortened as compared with the use of a circulation type apparatus, and the apparatus (500) is very useful, for example, when treatment of a lot of patients is necessary.

For automatic water extraction (excess water extraction) in FIG. 10, after stopping the feed of the carbonic acid gas and after a given amount of time has lapsed (for example, after 10 seconds), a magnetic valve (113) is opened for 5 seconds, and excess water is discharged out by the remaining pressure of the gas in the outer side of the hollow fiber membrane.

In the examples shown in FIGS. 9 and 10, the carbonic water production apparatuses (400) and (500) are preferably detachable from the body of the foot bath from the standpoints of maintenance, expendable item exchange, and the like. Specifically, it may be recommended that it be integrated into a panel composed of different angles to make a unit in the form of a box (skid) which can be removed easily.

The carbonic water production apparatuses equipped with foot baths as shown in FIGS. 9 and 10 described above are of a very suitable form for a carbonic water production apparatus since the bath and gas cylinder are integrated into one unit, portability is obtained, and carbonic water bathing can be carried out easily without selecting a permanent place. Patients utilizing foot baths often have ischemic ulcers due to a peripheral blood cell circulation deficiency, and may often use a wheel chair. Therefore, it is preferable that the apparatus of the present invention also has a size corresponding to a wheel chair. For example, a wheel chair is usually equipped with foot rests. It is convenient that if, in foot-bathing, these foot rests are lifted up on both sides, and the foot bath can be inserted under a wheel chair. In this case, the width of a foot bath should not be more than the inner size of the wheelchair when the foot rests are lifted up on both sides. Therefore, specifically, the width of a foot bath is preferably from about 300 to 350 mm. For example, the height and depth of a foot bath are advantageously set so that a patient in a wheel chair can insert the feet into the foot bath easily and the feet can be bathed as deeply as possible. Therefore, specifically, the height of a foot bath is preferably from about 350 to 450 mm, and the depth of a bath is preferably from about 250 to 350 mm.

The present invention will be illustrated further by the examples below.

First, Example A regarding the first present invention will be described.

EXAMPLE A1

Using the apparatus shown in the flow sheet of FIG. 1, carbonic water was produced as described below. For the carbonic acid gas dissolving apparatus (3), a dissolving apparatus was used containing the three-layer complex hollow fiber membrane described above at an effective total membrane area of 0.6 $m^2$, and carbonic acid gas was fed to the outer surface side of the hollow fiber membrane and raw water was fed to the hollow side, to dissolve the carbonic acid gas. For the circulation pump (1), a 3-head diaphragm pump manufactured by SHURflo, a diaphragm mode metering pump, was used.

Hot water in the amount of 10 L and a temperature of 35° C. was filled in the bath (11) and circulated at a flow rate of 5 L/min by the circulation pump (1), and simultaneously, carbonic acid gas was fed under a pressure of 0.05 MPa into the carbonic acid gas dissolving apparatus (5). As a result of the circulation, the concentration of carbonic acid gas in the hot water in the bath (11) gradually increased. The concentration of carbonic acid gas was measured by an ion meter IM40S manufactured by Toa Denpa Kogyo K.K., and using carbonic gas electrode CE-235. The measurement results of the concentration of carbonic acid gas at each circulation time are shown in Table 1. In production of carbonic water, excess water extraction was conducted automatically by an automatic water extraction function, and gas extraction was appropriately conducted.

Figure 4:
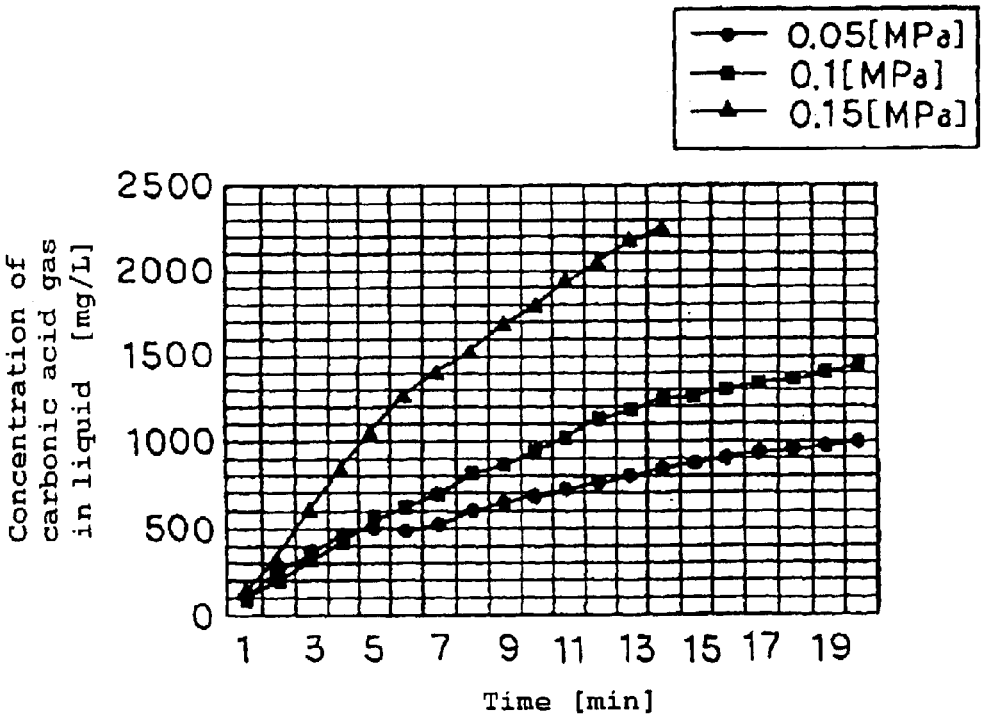
FIG. 4 is a graph showing a correlation between the circulation time and the concentration of carbonic acid gas in Example A1.

Further, carbonic water was produced in the same manner except that the feed pressure of the carbonic acid gas was changed to 0.10 MPa and 0.15 MPa. The circulation time and the concentration of carbonic acid gas in this case are also shown in Table 2. These are shown in the form of a graph in FIG. 4.

TABLE 1

| Correlation of circulation time and concentration of carbonic acid gas | | | |
|---|---|---|---|
| | Concentration of carbonic acid gas [mg/L] | | |
| Circulation time [min] | Gas feed pressure 0.05 MPa | Gas feed pressure 0.1 MPa | Gas feed pressure 0.15 MPa |
| 1 | 119 | 94 | 92.8 |
| 2 | 254 | 200 | 335 |
| 3 | 358 | 319 | 607 |
| 4 | 437 | 428 | 848 |
| 5 | 499 | 548 | 1057 |
| 6 | 490 | 623 | 1265 |
| 7 | 521 | 697 | 1410 |
| 8 | 594 | 814 | 1531 |
| 9 | 648 | 873 | 1699 |
| 10 | 691 | 945 | 1802 |
| 11 | 721 | 1029 | 1937 |
| 12 | 763 | 1135 | 2050 |
| 13 | 812 | 1189 | 2190 |
| 14 | 839 | 1250 | 2260 |
| 15 | 883 | 1270 | |
| 16 | 912 | 1308 | |
| 17 | 932 | 1351 | |
| 18 | 949 | 1372 | |
| 19 | 976 | 1406 | |
| 20 | 1008 | 1447 | |

Based on the data shown in Table 1, for example, if the intended concentration of carbonic acid gas to be produced is 1000 mg/L, the desired circulation times are determined as shown in Table 2 for feed pressures of carbonic acid gas of 0.05 MPa, 0.10 MPa and 0.15 MPa, respectively.

TABLE 2

| Feed pressure of carbonic acid gas | Concentration of carbonic acid gas | Necessary time |
|---|---|---|
| 0.05 MPa | 1008 mg/L | 20 min. |
| 0.10 MPa | 1029 mg/L | 11 min. |
| 0.15 MPa | 1057 mg/L | 5 min. |

In the first present invention, since a positive displacement metering pump with self-priming ability is used, carbonic water having a high concentration of about 1000 mg/L can also be circulated stably. Therefore, when water was again circulated for the desired times under three gas feed pressures, as shown in Table 2, carbonic water having a high concentration of about 1000 mg/L could be produced.

Comparative Example A1

Carbonic water was attempted to be produced in the same manner as in Example A1, except that a swirling pump was used as the circulation pump (1) instead of a diaphragm type metering pump, and an under-water pump (swirling mode) was also attached at the tip of an absorption hose in a bath to make the pressure at the pump absorption port positive (pushing). However, before reaching a high concentration of carbonic water (1000 mg/L), the pump stopped due to generation of bubbles.

The time from initiation of operation until the swirling pump is stopped due to the bubble entrainment and the concentration of carbonic acid gas at the stopping point are shown in Table 3.

TABLE 3

| Feed pressure of carbonic acid gas | Stop time | Final concentration |
|---|---|---|
| 0.05 MPa | 12 min. | 624 mg/L |
| 0.10 MPa | 4 min. | 750 mg/L |
| 0.15 MPa | 3 min. | 678 mg/L |

From the results shown in Table 3, it is shown that when a swirling pump is used the concentration of carbonic water increases until the pump is stopped by bubbles, and that consequently, having a high concentration of about 1000 mg/L cannot be produced.

As described above in the first present invention, when a positive-displacement metering pump is used, even if bubbles are generated in carbonic water having a high concentration, stable circulation is still possible. Furthermore, complicated control is not necessary, the configuration of the apparatus can be simplified significantly, the apparatus has a small size and has a low cost, and carbonic water having a high concentration can be produced by a simple operation at low cost. Furthermore, as compared with a one-pass type apparatus the setting is simple, and carbonic water can be produced more efficiently at low cost with low gas feed pressure. From such a standpoint, the first present invention is very useful as a domestic carbonic water production apparatus since, for example, it can be used only by filling a bath with hot water and putting a carbonic water circulation hose in the apparatus.

Next, Example B regarding the second present invention will be described.

EXAMPLE B1

The carbonic water production process according to the second present invention shown in FIG. 5 was carried out as described below.

For the carbonic acid gas dissolving apparatus (24), a dissolving apparatus was used containing the three-layer complex hollow fiber membrane described above at an effective total membrane area of 2.4 $m^2$, and carbonic acid gas was fed to the outer surface side of the hollow fiber membrane and raw water was fed to the hollow side, to dissolve the carbonic acid gas. For the filtration apparatus (26), RAF-40N was used (trade name, manufactured by Noritz Corp., ability: 4 t/H (67 L/min), 400 W) for the circulation pump (22), a commonly used swirling pump (270 W) was used, and for the bath (21), a large bath having a volume of 1000 L (1 $m^3$) was used. An initial step was carried out at a water temperature of 40° C., a circulation flow rate of 10 L/min/$m^2$ and a carbonic acid gas pressure of 0.2 MPa for 1 hour, consequently, the bath can be filled with carbonic water having a concentration of carbonic acid gas of 810 mg/L. Subsequently, a concentration maintaining step was carried out at a carbonic acid gas pressure of 0.1 MPa, and the concentration of carbonic acid gas in carbonic water in the bath could be maintained at 840 to 880 mg/L for 5 hours. The specific data in this example is shown in Table 4 below.

TABLE 4

| Lapsed time (hour:min) | Pressure of carbonic acid gas | Concentration of carbonic acid gas |
|---|---|---|
| 0:00 | 0.2 MPa | 10 mg/L |
| 0:30 | 0.2 MPa | 480 mg/L |
| 1:00 | 0.1 MPa | 810 mg/L |
| 1:30 | 0.1 MPa | 840 mg/L |
| 2:00 | 0.1 MPa | 850 mg/L |
| 2:30 | 0.1 MPa | 850 mg/L |
| 3:00 | 0.1 MPa | 860 mg/L |
| 3:30 | 0.1 MPa | 860 mg/L |
| 4:00 | 0.1 MPa | 870 mg/L |
| 4:30 | 0.1 MPa | 870 mg/L |
| 5:00 | 0.1 MPa | 870 mg/L |
| 5:30 | 0.1 MPa | 870 mg/L |
| 6:00 | 0.1 MPa | 880 mg/L |

As described above, according to the second present invention, the problem of evaporation of carbonic water once its produced is solved, and a certain concentration of carbonic acid gas can be produced and maintained by a simple operation at low cost for a long period of time.

Next, Example C regarding the third present invention will be described.

EXAMPLE C1

Carbonic water was produced as described below using the apparatus according to the flow sheet shown in FIG. 6. For the carbonic acid gas dissolving apparatus (45), a dissolving apparatus was used containing the three-layer complex hollow fiber membrane described above at an effective total membrane area of 2.4 $m^2$, and carbonic acid gas was fed to the outer surface side of the hollow fiber membrane and raw water was fed to the hollow side, to dissolve the carbonic acid gas.

First, the intended concentration of carbonic acid gas in carbonic water to be produced was set at 600 mg/L. Next, hot water (raw water) was prepared by heating tap water at 40° C. and was fed to the carbonic acid gas dissolving apparatus (45) at any flow rate. The flow rate of the hot water detected by the flow sensor (43) was 15 L/min.

The carbonic acid gas was fed to the carbonic acid gas dissolving apparatus (45) while automatically controlling the feed pressure of carbonic acid gas so that the concentration of carbonic acid gas of the resulting carbonic water was 600 mg/L, based on this flow rate data and the correlation data shown in FIG. 7 previously recorded. The feed pressure of the carbonic acid gas in this operation was specifically 0.16 MPa. The concentration of carbonic acid gas in carbonic water thus produced was measured by an ion meter IM40S manufactured by Toa Denpa Kogyo K.K., carbonic acid gas electrode CE-235. The results are shown in Table 5. In production of carbonic water, excess water extraction or drainage was conducted automatically by an automatic water extraction function, and gas extraction was appropriately conducted.

Further, carbonic water was produced in the same manner except that the intended concentration of carbonic acid gas was set at 1000 mg/L (flow rate of hot water: 15 L/min). The feed pressure of carbonic water was specifically 0.30 MPa. The concentration of carbonic acid gas in carbonic water thus produced was measured in the same manner. The results are shown in Table 5.

TABLE 5

| Flow rate of hot water is 15 L/min | | |
|---|---|---|
| Set concentration | Feed pressure of carbonic acid gas | Actual measured concentration |
| 600 mg/L | 0.16 MPa | 640 mg/L |
| 1000 mg/L | 0.30 MPa | 1090 mg/L |

From the results shown in Table 5 it is apparent that carbonic water having the intended concentration could be produced with little error, for any specified concentration case.

EXAMPLE C2

Carbonic water was produced in the same manner as in Example C1 except that the flow rate of hot water was 5 L/min. The results are shown in Table 6.

TABLE 6

| Flow rate of hot water is 5 L/min | | |
|---|---|---|
| Set concentration | Feed pressure of carbonic acid gas | Actual measured concentration |
| 600 mg/L | 0.05 MPa | 615 mg/L |
| 1000 mg/L | 0.14 MPa | 1050 mg/L |

From the results shown in Table 6 it is apparent that carbonic water having the intended concentration could be produced with little error, for any specified concentration case. From the results of Examples C1 and C2, it is also shown that carbonic water having the intended concentration can be produced with little error, even if the flow rate of hot water (raw water) is indefinite.

As described above according to the third present invention, complicated control is not necessary, the configuration of the apparatus can be simplified significantly, the apparatus has a small size and has a low cost, and carbonic water having the intended concentration of carbonic acid gas can be produced in a simple manner. Particularly, the third present invention can also be applied when raw water is fed from a faucet of a general water line and additionally, since the apparatus is compact, it is very useful as an apparatus for water treatment which can be applied easily to known baths including domestic baths.

Next, Example D regarding the fourth present invention will be described.

EXAMPLE D1

Carbonic water was produced using the apparatus according to the flow sheet shown in FIG. 6. For the carbonic acid gas dissolving apparatus (45), a dissolving apparatus was used containing the three-layer complex hollow fiber membrane described above at an effective total membrane area of 2.4 $m^2$, and carbonic acid gas was fed to the outer surface side of the hollow fiber membrane and raw water was fed to the hollow side, to dissolve the carbonic acid gas.

First, the intended concentration of carbonic acid gas in carbonic water to be produced was set at 1000 ppm. Next, hot water (raw water) was prepared by heating tap water at 40° C. and was fed to the carbonic acid gas dissolving apparatus (45) at any flow rate. The flow rate of the hot water detected by the flow sensor (43) was 15 L/min. Here, the carbonic acid gas was fed to the carbonic acid gas dissolving apparatus (45) while appropriately controlling the feed pressure of carbonic acid gas so the concentration of carbonic acid gas of the resulting carbonic water was 1000 mg/L. The feed pressure of carbonic water was specifically 0.30 MPa. The concentration of carbonic acid gas in carbonic water thus produced was about 1000 ppm.

This carbonic water production was continued for 1 hour, then the feeding of raw water and the feeding of carbonic acid gas were stopped. As intended, 10 seconds after stopping the feed, the magnetic valve (53) of the apparatus was opened automatically for 5 seconds. During this operation, excess water was discharged successfully from the apparatus, under a remaining gas pressure from the hollow fiber membrane in the carbonic acid gas dissolving apparatus (45) at about 0.05 Mpa. Furthermore, no hammer phenomenon occurred.

EXAMPLE D2

Carbonic water was produced using the apparatus according to the flow sheet shown in FIG. 3. For the carbonic acid gas dissolving apparatus (3), a dissolving apparatus was used containing the three-layer complex hollow fiber membrane described above at an effective total membrane area of 0.6 $m^2$, and carbonic acid gas was fed to the outer surface side of the hollow fiber membrane and raw water was fed to the hollow side, to dissolve the carbonic acid gas.

Hot water in the amount of 10 L and a temperature of 35° C. filled the bath (11) and was circulated at a flow rate of 5 L/min by the circulation pump (1), and simultaneously, carbonic acid gas was fed under a pressure of 0.15 MPa to the carbonic acid gas dissolving apparatus (3). As a result of this circulation, the concentration of the carbonic acid gas in hot water in the bath (11) increased gradually. When this circulation was continued for 5 minutes, the concentration of carbonic water in the bath reached around 1000 ppm. Since the operation was repeated several times (integration time: 4 hours or more), excess water was collected in the carbonic acid gas dissolving apparatus (3) after production of carbonic water. At completion of the next operation, the magnetic valve (7) was automatically opened for 1 second, as set. As the carbonic acid gas magnetic valve (6) was opened, a gas pressure of 0.15 MPa was applied, and under this pressure the excess water was discharged successfully out of the apparatus. Furthermore, the same carbonic water production was repeated, and consequently after every operation for an integrated operation time of 4 hours or more, water extraction was successfully conducted automatically in initiation of the next operation, as set.

As described above, according to the fourth present invention, effective membrane area can always be secured, without requiring manual excess water extraction, and carbonic water of a high concentration can be successfully produced by a simple operation, as a result, the fourth present invention is very practical.

Next, Example E will be described, in which feeding to a plurality of use points is conducted.

EXAMPLE E1

Carbonic water was produced and fed as described below, according to the example shown in FIG. 8. In the carbonic water production apparatus (100), a carbonic acid gas dissolving apparatus (65) was used containing the three-layer complex hollow fiber membrane described above at an effective total membrane area of 2.4 $m^2$, and carbonic acid gas was fed to the outer surface side of the hollow fiber membrane and raw water was fed to the hollow side, to dissolve the carbonic acid gas. The water storage tank (200) was a tank in the form of a cylinder having an inner volume of 1000 L. The carbonic acid gas saturation concentration in the water storage tank (200) is about 1100 mg/L at 40° C. under atmospheric pressure, the production concentration in the carbonic water production apparatus (100) was 1000 mg/L. The number of use points were 5 in total, water is fed via each point into each bath of 250 L, supposing the water can be fed at a maximum rate of about 15 L/min at each use point, and a commonly used swirling pump with a water conveying ability of 100 L/min was used as the water conveying pump (82).

First, hot water (raw water) prepared by heating tap water at 40° C. was fed to the carbonic acid gas dissolving apparatus (65) at a flow rate of 15 L/min, and carbonic acid gas was fed to the carbonic acid gas dissolving apparatus (65) under a feed pressure of 0.30 Mpa. The concentration of carbonic acid gas in the produced carbonic water was about 1000 ppm, and this was fed to the water storage tank (200). Carbonic water in the water storage tank (200) was kept at 40° C. This carbonic water could be successfully fed to each use point (300) by the water conveying pump (82).

As described above in this example, equipment cost could be reduced by having one carbonic water production apparatus even when carbonic water was fed to a plurality of use points (e.g., bath). Namely, by effecting such an application, operation can be carried out by one carbonic water production apparatus, even in a facility having a lot of use points provided, and a large amount of carbonic water can be stored in a water storage tank. Therefore, even when large amounts of carbonic water are necessary at one time, a small dissolving apparatus can be used in a carbonic water production apparatus, and by this, equipment costs are lowered. Furthermore, carbonic water with a high concentration and physiological effects can be supplied easily in a stable manner.

Next, Example F regarding the fifth present invention will be described.

EXAMPLE F1

A foot bath using the circulation type carbonic water production apparatus shown in FIG. 9 was produced as described below and used. In the carbonic water production apparatus (400), a carbonic acid gas dissolving apparatus (106) was used containing the three-layer complex hollow fiber membrane described above at an effective total membrane area of 0.6 $m^2$, and carbonic acid gas was fed to the outer surface side of the hollow fiber membrane and raw water was fed to the hollow side, to dissolve the carbonic acid gas. For the circulation pump (104), a commonly used swirling pump (magnet pump manufactured by Iwaki) was used. The size of the foot bath was set within the above-mentioned range corresponding to a wheel chair, and hot water was circulated for 3 minutes at a bath volume of 11 L, a water temperature of 40° C. and a circulation flow rate of 5.4 L/min, consequently, the bath was filled with carbonic water having the concentrations shown in Table 7 below.

TABLE 7

| Pressure of carbonic acid gas | Concentration of carbonic acid gas |
|---|---|
| 0.1 MPa | 520 mg/L |
| 0.2 MPa | 815 mg/L |

The concentration of carbonic acid gas is a value measured by a measuring apparatus (IM-40) manufactured by Toa Denpa K.K.

EXAMPLE F2

A foot bath using the one-pass type carbonic water production apparatus shown in FIG. 10 was produced as described below and used. In the carbonic water production apparatus (500), a carbonic acid gas dissolving apparatus (106), was used containing the three-layer complex hollow fiber membrane described above at an effective total membrane area of 0.6 $m^2$, and carbonic acid gas was fed to the outer surface side of the hollow fiber membrane and raw water was fed to the hollow side, to dissolve the carbonic acid gas. The size of the foot bath was set within the above-mentioned range corresponding to a wheel chair, and the water temperature was controlled to 40° C., the raw water flow rate was controlled to 5.4 L/min, and the carbonic acid gas pressure was controlled to 0.2 MPa, then, carbonic water having a concentration of carbonic acid gas of 794 mg/L could be filled in the bath.

As described above, according to the fifth present invention, a bath can be provided for which the operation and use is simple and which retains the advantages of portable foot baths.

What is claimed is:

1. A carbonic water production apparatus which is equipped with a carbonic acid gas dissolving apparatus and a circulation pump wherein water in a water tank is circulated through the carbonic acid gas dissolving apparatus by the circulation pump, and a carbonic acid gas is fed into the carbonic acid gas dissolving apparatus to dissolve the carbonic acid gas in the water, and which is characterized in that the circulation pump is a diaphragm metering pump having a self-priming ability.

2. A carbonic water production method which comprises circulating water in a water tank through a carbonic acid gas dissolving apparatus by a circulation pump, and feeding a carbonic acid gas into the carbonic acid gas dissolving apparatus to dissolve the carbonic acid gas in the water, and which is characterized in that a diaphragm pump having a self-priming ability is used as the circulation pump.

3. The carbonic water production method according to claim 2, wherein the feeding pressure of the carbonic acid gas is in the range from 0.01 to 0.3 MPa.

4. The carbonic water production apparatus according to claim 1, wherein the carbonic acid gas dissolving apparatus is a membrane type carbonic acid gas dissolving apparatus.

5. The carbonic water production apparatus according to claim 4, wherein the membrane type carbonic acid gas dissolving apparatus is a carbonic acid gas dissolving apparatus having a non-porous gas permeable membrane.

6. The carbonic water production method according to any of claims 2 or 3, wherein the carbonic acid gas dissolving apparatus is a membrane type carbonic acid gas dissolving apparatus.

7. The carbonic water production method according to claim 6, wherein the membrane type carbonic acid gas dissolving apparatus is a carbonic acid gas dissolving apparatus having a non-porous gas permeable membrane.

8. The carbonic water production apparatus according to claim 1, which is further equipped with a bubble generation apparatus or an injection apparatus.

9. The carbonic water production apparatus according to claim 1, which is equipped with a carbonic water production apparatus and a water storage tank, and wherein a carbonic water produced by the carbonic water production apparatus is stored in the water storage tank, and then the carbonic water stored in the water storage tank is fed to a plurality of use points by a water conveying pump.

10. The carbonic water production apparatus according to claim 9, wherein a gas phase inside of the water storage tank is filled with a carbonic acid gas and kept at a gas pressure of 1 kPa to 3 kPa.

11. The carbonic water production apparatus according to claim 9, wherein a carbonic acid gas is additionally fed into the gas phase inside of the water storage tank when the water level of carbonic water inside of the water storage tank is downed, and the carbonic acid gas of the gas phase inside the water storage tank is partially discharged when the water level of carbonic water inside of the water storage tank is upped.

12. The carbonic water production apparatus according to claim 9, which is equipped with an insertion tube inside of the water storage tank wherein the tube feeds the carbonic water produced by the carbonic water production apparatus into the water storage tank.

* * * * *